US007112401B2

(12) United States Patent
Nakagawa

(10) Patent No.: US 7,112,401 B2
(45) **Date of Patent: *Sep. 26, 2006**

(54) PHOTOTHERMOGRAPHIC MATERIAL AND IMAGE FORMING METHOD USING THE SAME

(75) Inventor: Hajime Nakagawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/220,846

(22) Filed: Sep. 8, 2005

(65) Prior Publication Data

US 2006/0057514 A1 Mar. 16, 2006

(30) Foreign Application Priority Data

Sep. 13, 2004 (JP) ..... 2004-265899

(51) Int. Cl.
*G03C 1/00* (2006.01)

(52) U.S. Cl. ..... 430/617; 430/618; 430/619; 430/620; 430/964

(58) Field of Classification Search ..... 430/617–620, 430/964
See application file for complete search history.

(56) References Cited

U.S. PATENT DOCUMENTS

| | | | |
|---|---|---|---|
| 6,630,291 | B1 | 10/2003 | Maskasky et al. |
| 6,713,241 | B1 | 3/2004 | Vaeth et al. |
| 2004/0053173 | A1 | 3/2004 | Maskasky et al. |

*Primary Examiner*—Geraldine Letscher
(74) *Attorney, Agent, or Firm*—Margaret A. Burke; Sheldon J. Moss

(57) ABSTRACT

A photothermographic material comprising a support body provided on or above at least one surface thereof with an image forming layer, containing at least a photosensitive silver halide, a non-photosensitive organic silver salt, a reducing agent and binder, and a non-photosensitive layer, wherein:
1) 50% or more of the binder in the image forming layer is hydrophilic binder;
2) a ratio of the non-photosensitive organic silver salt to the hydrophilic binder is from 0.6 to 1.4 by mass; and
3) 70% or more of binder in the non-photosensitive layer is hydrophilic binder.

14 Claims, 1 Drawing Sheet

PHOTOTHERMOGRAPHIC MATERIAL AND IMAGE FORMING METHOD USING THE SAME

This application claims priority under 35 USC 119 from Japanese Patent Application No. 2004-265899, the disclosure of which is incorporated by reference herein.

BACKGROUND OF THE INVENTION

1. Field of the Invention

The present invention relates to a photothermographic material having an excellent coated surface and a reduced fogging, and an image forming method using the same.

2. Description of the Related Art

In recent years, decrease in the amount of processing liquid waste in the field of films for medical imaging has been keenly desired from the viewpoints of environmental protection and economy of space. For this reason, techniques regarding photothermographic materials for medical diagnosis and graphic arts, which can be exposed efficiently by laser image setters or laser imagers and can form clear black-toned images of high resolution and sharpness, are required. With the photothermographic materials described above, thermal development systems which do not require liquid processing chemicals, are simpler, and do not damage the environment can be supplied to customers.

While similar requirements also exist in the field of general image forming materials, images for medical imaging require a particularly high image quality excellent in sharpness and granularity since fine representation is required, and are characterized in that images of blue-black tones are preferred from the viewpoint of easy diagnosis. At present, various kinds of hard copy systems utilizing dyes or pigments such as ink jet printers and electrophotographic systems have been marketed as general image forming systems, but they are not satisfactory as output systems for medical images.

Thermal image forming systems utilizing organic silver salts are described in a number of documents. Photothermographic materials generally comprise an image forming layer in which a catalytically active amount of photo catalyst (for example, a silver halide), a reducing agent, a reducible silver salt (for example, an organic silver salt), and if necessary, a toning agent for controlling the color tone of silver, dispersed in a binder. A photothermographic material forms a black silver image by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed in the exposed region. Further, the Fuji Medical Dry Imager FM-DP L is has been marketed as a medical image forming system using a photothermographic material.

In the manufacture of thermographic image forming systems using organic silver salts, there is a method of manufacture by solvent coating, and a method of coating, with a coating liquid containing an aqueous dispersion of polymer fine particles of mainly binder, and drying. Because there is no need for a solvent recovery process in the later method the manufacturing facilities are simple, the environmental load is small, and it is advantageous for large scale production. However, because the coating liquid does not having a setting property, after application of the coating liquid the film can be distorted by the drying air, and there is the problem that drying blemishes can easily develop.

The use of hydrophilic binders such as gelatin has been proposed (see, for example, the publications of U.S. Pat. Nos. 6,630,291 and 6,713,241). But this is not usable in practice, since the thermographic activity is low, and when the activity is increased in order to try to obtain sufficient images there is the problem that there is a large amount of fogging.

With thermographic materials there is a need to include in advance within the film the chemical components necessary for image forming. Because of this, the chemical components influence the storage stability up to the time when the photothermographic material is used. Also, after forming of an image by thermal development, the chemical components remain within the film in an un-reacted state or as reaction products, and this has a great influence on the film transparency and image tone, and the image storage stability.

There is even more of a problem with these storage stabilities when the above hydrophilic binder is used then, and improvement is required.

The inventors have investigated photothermographic materials which can give a superior coating surface state, using as the binder in the image forming layer hydrophilic binders, such as gelatin, with setting characteristics. Conventionally, hydrophilic binders are use in wet development type silver halide photosensitive materials. However, when used as a binder for photothermographic materials a problem was discovered that never arose with wet development type silver halide photosensitive materials. The fundamental problem is, because the developing activity is extremely low, the image density is low, and the sensitivity is low. In order to increase the thermal developing properties, lowering the amount of hydrophilic binder in the image forming layer, that is, increasing the ratio of organic silver salt relative to the hydrophilic binder was tried. However, when the ratio of organic silver salt to hydrophilic binder was raised it generated greatly increased fogging, or worsening of the raw storage stability and image storage stability. Furthermore, the problem of contamination of unexpected portions of plates of the thermo developing portions and of heating elements, such as the drum, was encountered. The reason for the contamination is thought to be that volatile materials are generated at the time of thermal development from the photothermographic materials and these become adhered to the peripheral elements. As a result of extensive research into how to solve this new problem, the maintaining of the ratio of organic silver salt relative to the hydrophilic binder within a predetermined range was discovered, as a means of improving the developing activity, which resulted in this invention being arrived at. Also, by using the photothermographic materials used in the invention, an image forming method has been discovered providing rapid image formation, giving rise to the image forming method of the invention.

SUMMARY OF THE INVENTION

The present invention has been made in view of the above circumstances and provides an image forming method which uses a photothermographic material with a superior coating surface state and low fogging.

The invention has been achieved by using an image forming method using the photothermographic materials described below.

A first aspect of the invention is to provide a photothermographic material comprising a support body provided on or above at least one surface thereof with an image forming layer, containing at least a photosensitive silver halide, a non-photosensitive organic silver salt, a reducing agent and binder, and a non-photosensitive layer, wherein:

1) 50% or more of the binder in the image forming layer is hydrophilic binder;
2) a ratio of the non-photosensitive organic silver salt to the hydrophilic binder is from 0.6 to 1.4 by mass;
3) 70% or more of binder in the non-photosensitive layer is hydrophilic binder;
4) the photothermographic material includes at least one of the compounds represented by the Formulae I or II below.

Formula I

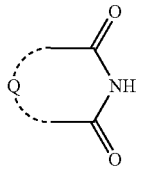

wherein Q represents an atomic group necessary for forming a 5 or 6 member imide ring.

Formula II

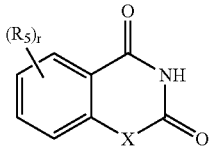

wherein $R_5$ (s) independently represent a hydrogen atom, an alkyl group, a cycloalkyl group, an alkoxy group, an alkylthio group, an arylthio group, a hydroxy group, a halogen atom, or $N(R_8R_9)$ group, where $R_8$ and $R_9$ each independently represent a hydrogen atom, an alkyl group, an aryl group, a cycloalkyl group, an alkenyl group or a hetero ring; r is 0, 1 or 2; $R_8$ and $R_9$ can be linked together to form a substituted or unsubstituted 5 to 7 member hetero ring; 2 of the $R_5$ groups can be linked together to form an aromatic, hetero aromatic, alicyclic ring or condensed hetero cyclic ring; X represents O, S, Se or $N(R_6)$, were $R_6$ is a hydrogen atom, alkyl group, aryl group, cycloalkyl group, alkenyl group or heterocyclic group.

A second aspect of the invention is to provide the photothermographic material of the first aspect wherein a ratio of an amount of silver relative to the hydrophilic binder in the image forming layer is from 0.6 to 1.2 by mass.

A third aspect of the invention is to provide the photothermographic material of the first aspect containing at least one of a polyacrylamide or a derivative thereof.

A fourth aspect of the invention is to provide the photothermographic material of the third aspect where the non-photosensitive organic silver salt is one in which non-photosensitive organic silver salt particles are formed in the presence of at least one of a polyacrylamide or a derivative thereof.

A fifth aspect of the invention is to provide the photothermographic material of the third aspect wherein the non-photosensitive organic silver salt has been water washed with an aqueous solution containing the at least one of a polyacrylamide or a derivative thereof.

A sixth aspect of the invention is to provide the photothermographic material of the third aspect wherein the non-photosensitive organic silver salt is in the form of nano particles.

A seventh aspect of the invention is to provide the photothermographic material of the sixth aspect wherein an average particle size of the nano particles is from 10 nm to 500 nm.

An eighth aspect of the invention is to provide the photothermographic material of the sixth aspect wherein the non-photosensitive layer is the outermost layer on the same side as the image forming layer.

A ninth aspect of the invention is to provide the photothermographic material of the second aspect wherein the hydrophilic binder in the image forming layer is gelatin or a gelatin derivative.

A tenth aspect of the invention is to provide the photothermographic material of the second aspect wherein the hydrophilic binder in the non-photosensitive layer is gelatin or a gelatin derivative.

An eleventh aspect of the invention is to provide the photothermographic material of the ninth aspect wherein the gelatin or gelatin derivative contains a thickening agent.

A twelfth aspect of the invention is to provide the photothermographic material of the first aspect wherein the reducing agent is one represented by the following Formula R:

Formula R

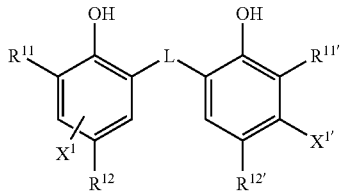

where: $R^{11}$ and $R^{11'}$ each independently represent an alkyl group, and at least one of which is a secondary or tertiary alkyl group; $R^{12}$ and $R^{12'}$ each independently represent a hydrogen atom, or a substitute group which is substitutable for a hydrogen atom on a benzene ring; L represents an —S— group, or a —$CHR^{13}$— group, where $R^{13}$ represents a hydrogen atom or an alkyl group; $X^1$ and $X^{1'}$ each independently represent a hydrogen atom or a substitute group which is substitutable for a hydrogen atom on a benzene ring.

A thirteenth aspect of the invention is to provide the photothermographic material of claim 12 which further includes a development accelerator.

A fourteenth aspect of the invention is to provide the image forming method using the photothermographic material of claim 13 in which, when the photothermographic material is being developed, the linear speed is from 23 mm per second to 200 mm per second.

DETAILED DESCRIPTION OF THE INVENTION

Figure 1:
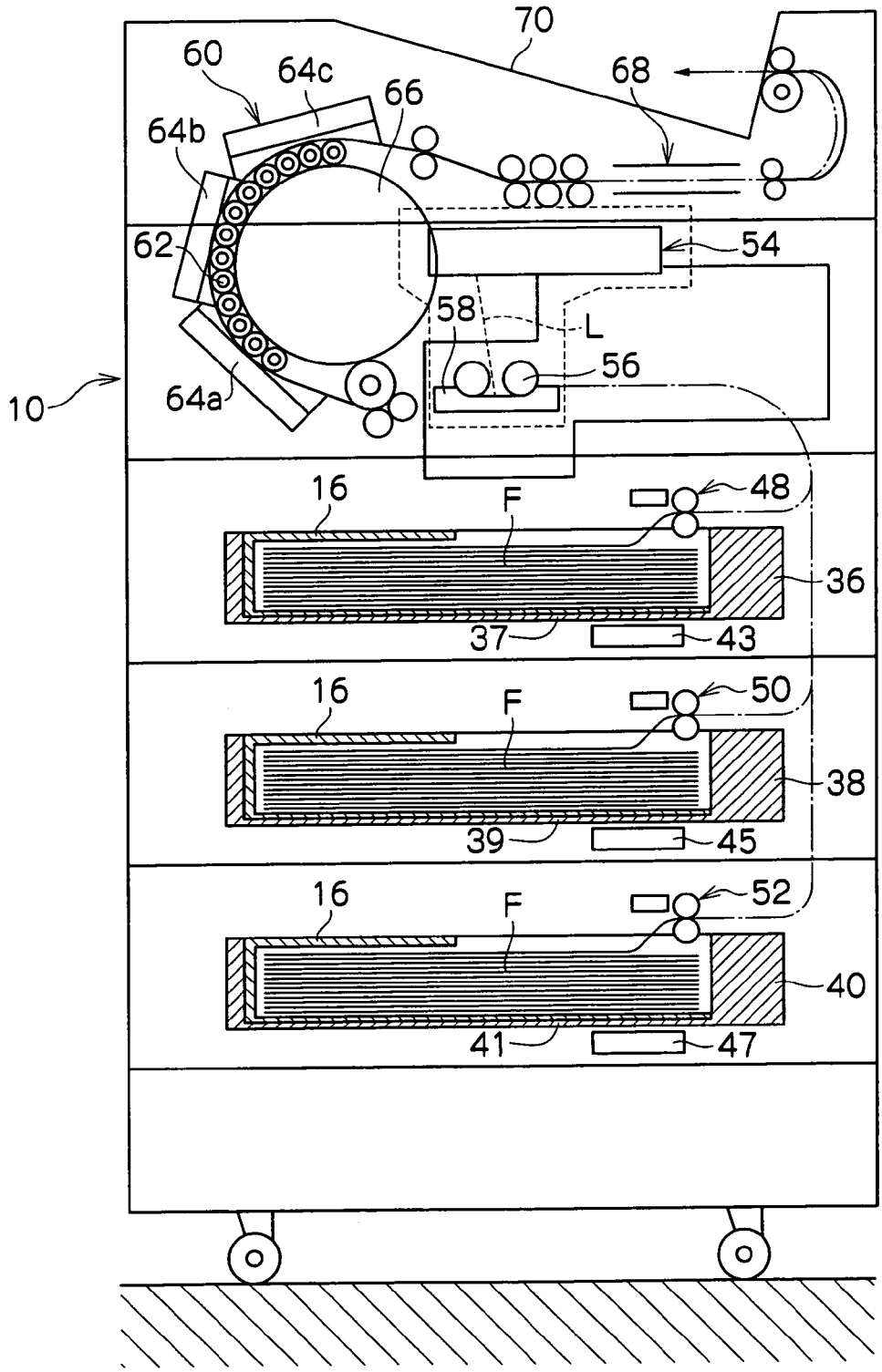
FIG. 1 is a schematic block diagram of a photothermographic apparatus used in the invention.

Details of the invention will be described below.

1. Photothermographic Material

The photothermographic material of the invention comprises a support body provided on or above at least one surface thereof with an image forming layer, containing at least a photosensitive silver halide, a non-photosensitive organic silver salt, a reducing agent and binder, and a non-photosensitive layer. The image forming layer of the invention can be provided on or above the support body as a single layer construction or a multiple layer construction, and, as required, it can include additional desired materials such as toner, coating promoter, or other adjuvants. The non-photosensitive layer of the invention can be a single layer or multiple layers.

In the image forming layer of the photothermographic material of the invention 50% by mass or more of the binder is hydrophilic binder, and the ratio of the amount of silver relative to the hydrophilic binder is 0.6 to 1.4 by mass. It is preferable that at least one of the imide group containing compounds shown in the Formulae I or II is included in the image forming layer.

An amount of 70% or more by mass of binder in the non-photosensitive layer is hydrophilic binder.

It is preferable that the non-photosensitive organic silver salt of the invention is formed as particles in the presence of at least one of polyacrylamides or derivatives thereof. It is even more preferable that the non-photosensitive organic silver salt of the invention is water washed with an aqueous solution containing the at least one of polyacrylamides or derivatives thereof.

It is preferable that the non-photosensitive organic silver salt of the invention is formed as nano particles, and even more preferable that these nano particles have an average particle size of 10 nm to 500 nm.

It is preferable in the invention that the non-photosensitive layer is the outside layer on the same side as the image forming layer.

It is preferable in the invention that the hydrophilic binder of the outermost layer is gelatin or a gelatin derivative.

It is preferable in the invention that there is included a thickening agent for gelatin or gelatin derivative.

It is preferable in the invention that a reducing agent as represented by Formula R is included.

It is preferable in the invention that a development accelerator is included.

For a image forming method using the photothermographic material of the invention, thermographic developing forming an image is carried out with a linear speed of from 23 mm per second to 200 mm per second.

(Organic Silver Salt)

1) Composition

The organic silver salt according to the invention is relatively stable to light but is a silver salt which serves so as to supply silver ions and form silver images when heated to 80° C. or higher in the presence of an exposed photosensitive silver halide and a reducing agent. The organic silver salt may be any organic material containing a source capable of reducing silver ions. Such non-photosensitive organic silver salts are disclosed, for example, in JP-A No. 10-62899 (paragraph Nos. 0048 to 0049), EP-A No. 0803764A1 (page 18, line 24 to page 19, line 37), EP-A No. 0962812A1, JP-A Nos. 11-349591, 2000-7683, and 2000-72711, and the like. A silver salt of organic acid, particularly, a silver salt of a long chained fatty acid carboxylic acid (having 10 to 30 carbon atoms, preferably, having 15 to 28 carbon atoms) is preferable. Preferred examples of fatty acid silver salts can include, for example, silver lignocerate, silver behenate, silver arachidinate, silver stearate, silver oleate, silver laurate, silver capronate, silver myristate, silver palmitate, silver erucate and mixtures thereof. In the present invention, among fatty acid silver salts, it is preferred to use a fatty acid silver salt with a silver behenate content of 50 to 100 mole %, more preferably, 85 to 100 mole %, and further preferably, 95 to 100 mole %. Further, it is preferred to use a fatty acid silver salt with silver erucate content of 2 mole % or less, more preferably, 1 mole % or less, and further preferably, 0.1 mole % or less.

It is preferred that the content of the silver stearate is 1 mole % or less. When the content of the silver stearate is 1 mole % or less, a silver salt of organic acid having low Dmin, high sensitivity and excellent image stability can be obtained. The content of the silver stearate is preferably 0.5 mole % or less, and more preferably, substantially no silver stearate is contained.

Further, in the case the silver salt of organic acid includes silver arachidinic acid, it is preferred that the content of the silver arachidinic acid is 6 mole % or less in order to obtain a silver salt of organic acid having low Dmin and excellent image stability. The content of the silver arachidinate is more preferably 3 mole % or less.

2) Shape

The organic silver salt of the invention is preferably in the form of nano particles. These particles preferably have an average particle size of 10 nm to 500 nm, and more preferably from 20 nm to 300 nm.

When it is less than these ranges then fogging at the time of developing is high, and when greater then problems occur such as the developing activity reduces, or the film strength decreases. Therefore it is preferable to be within these ranges.

There is no particular restriction on the shape of the organic silver salt usable in the invention and it may needle-like, bar-like, tabular, or flaky shape.

In the invention, a flaky shaped organic silver salt is preferred. Short needle-like, rectangular, cuboidal or potato-like indefinite shaped particles with the major axis to minor axis ratio being 5 or less are also used preferably. Such organic silver particles have the characteristic that they suffer less from fogging during thermal development compared with long needle-like particles with a major axis to minor axis length ratio of more than 5. Particularly, particles with a major axis to minor axis ratio of 3 or less are preferred since they can improve the mechanical stability of the coating film. In the present specification, the flaky shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter sides as below.

$$x=b/a$$

As described above, x is determined for about 200 of the particles and particles capable of satisfying the relation: x (average)≧1.5 as an average value x are defined as flaky shaped. The relation is preferably: 30≧x (average)≧1.5 and, more preferably, 15≧x (average)≧1.5. For reference, needle-like is expressed as 1≦x (average)<1.5.

In flaky shaped particles, a can be regarded as a thickness of a tabular particle having a main plate with b and c being as the edges. The average of a is preferably 5 nm to 300 nm and, more preferably, 10 nm to 100 nm. The average of c/b is preferably between 1 and 9, more preferably, 1 and 6, further preferably, 1 and 4 and, most preferably between 1 and 3.

In the invention, for a method of determining the diameter of an equivalent sphere, this can be obtained by photographing a sample directly with an electron microscope, and then developing the negative.

The flakey shaped particles will be defined in terms of the aspect ratio of the diameter of an equivalent sphere/a. This aspect ratio of flakey particles, from the perspectives of being disinclined to clump together in the photothermographic material, and giving good image preservation, is preferably 1.1 to 30, and more preferably 1.1 to 15.

As the particle size distribution of the organic silver salt, monodispersion is preferred. In the monodispersion, the percentage values obtained by dividing the standard deviation of the length of minor axis and major axis by the minor axis and the major axis respectively are, preferably, 100% or less, more preferably, 80% or less and, further preferably, 50% or less. The shape of the organic silver salt can be measured by transmission type electron microscopic images of a dispersion of the organic silver salt. Another method of measuring the monodispersion is a method of determining the standard deviation of the volume weighted mean diameter of the organic silver salt, and the percentage value (variation coefficient) defined by dividing the above standard deviation by the volume weight mean diameter, is preferably, 100% or less, more preferably, 80% or less and, further preferably, 50% or less. This can be calcluated from the particle size (volume weighted mean diameter) obtained, for example, by a measuring method of irradiating a laser beam to an organic silver salt dispersed in a liquid, and determining an autocorrelation function of the fluctuation of scattered light with time.

3) Preparation

It is preferable that for the organic silver salt of the invention is dispersed by at least one dispersing agent of a polyacrylamide or derivative thereof.

These dispersing agents can be added at the time of the preparation of the organic silver salt, or added at the time of dispersion. However, it is preferable that particles of the organic silver salt are formed in the presence of these dispersing agent(s). It is more preferable that the dispersing agent(s) are present when a desalting process is carried out after forming of the particles.

The above particles can be prepared within the size range by adjusting the temperature, pH, and pAg at the time of particle formation or dispersion.

It is preferable to use one of the compounds represented in the Formulae W1 and W2 below as the dispersing agents of the at least one of polyacrylamides or derivatives thereof of the invention.

Formula (W1)

Formula (W2)

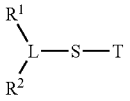

R represents a hydrophobic group. At least one of $R_1$ or $R_2$ is a hydrophobic group. L is a bivalent linking group. T is an oligomer moiety.

The number of hydrophobic groups are determined by the linking group L. As hydrophobic groups saturated or unsaturated alkyl groups, arylalkyl groups or alkylaryl groups can be selected, and the respective alkyl moieties thereof can be straight or branched chains. It is preferable that hydrophobic R, $R_1$, and $R_2$ groups have 8 to 21 carbon atoms. The linking group L is simply linked with a chemical bond(s) to the hydrophobic group(s) and via a thio bond (—S—) to the oligomer moiety T. Typical linking groups which are an attaching substance to a single hydrophobic group are shown below in italics:

Formula (Wa)

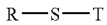

Formula (Wb)

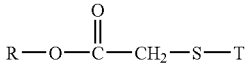

Formula (Wc)

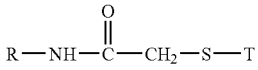

Typical linking groups for substances when there are two hydrophobic groups involved are shown below in italics:

Formula (Wd)

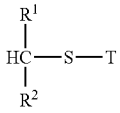

Formula (We)

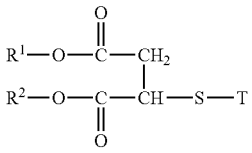

Formula (Wf)

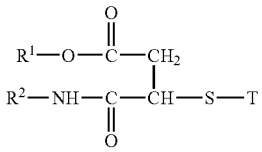

The oligomer moiety T is a group of a oligomerized vinyl monomer with an amide functional group, the vinyl portion provides the route for oligomerization, and the amide portions provides (after oligomerization) non-ionic polar groups constructed with hydrophilic functional groups. This oligomer group T can be synthesized from a monomer blend, if a source monomer or obtainable oligomer chain is sufficiently hydrophilic, and the obtained surface active substance can be dissolved or dispersed in water. In order to synthesize the oligomer T typical monomers are based on acrylamide, metacrylamide, acrylamide derivatices, metacrylamide derivatives, and 2-vinyl pyrrolidone but, the last compound is not really preferable since it sometimes is harmful to the photographic process by polyvinyl pyrrolidone (PVP).

These monomers can be represented by the following two types of Formula.

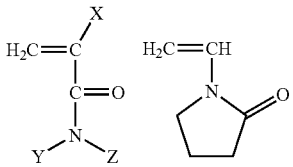

Acrylamides, Metacrylamides, and derivatives thereof. 2-vinyl pyrrolidone X is typically H or $CH_3$, generating, respectively, acrylamide and metacrylamide based monomers. Y and Z are typically, H, $CH_3$, $C_2H_5$, $C(CH_2OH)_3$, and X can be the same as, or different from Y.

BUN-1

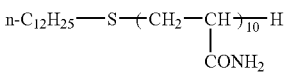

BUN-2

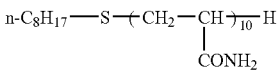

BUN-3

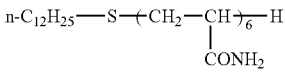

BUN-4

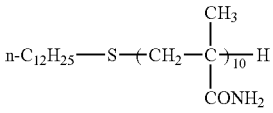

BUN-5

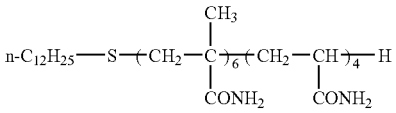

BUN-6

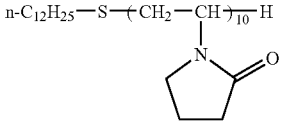

BUN-7

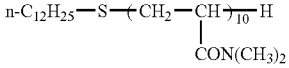

BUN-8

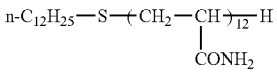

BUN-9

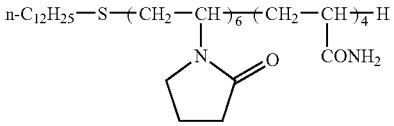

BUN-10

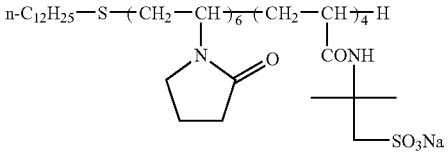

Surfactants mainly comprised of polyvinyl monomers attached to amide functional groups can be manufactured using known methods in the art, or with simple modifications to know methods. An exemplary preparation is shown below. A water based nano particle silver carboxylate dispersion material can be synthesized using a medium attrition method including the processes below:

(A) preparing a silver carboxylate suspension material preparation, including silver carboxylate, water as a carrier for the carboxylate salt and the above surfactants;

(B) blending the silver carboxylate suspension material with a medium for hard attrition, with particles with average diameter of less than 500 μm;

(C) introducing the blended material from (B) into a high speed mill;

(D) attriting the blended material from (C) until the distribution of carboxylate salt particle diameters is one in which 90% by mass of the carboxylate salt particles are less than 1 μm in diameter;

(E) separating the attrited blend material from the attrition medium.

When a photosensitive silver salt is present together during dispersion of the organic silver salt, fogging increases and sensitivity becomes remarkably lower, so that it is more preferred that the photosensitive silver salt is not substantially contained during dispersion. In the invention, the amount of the photosensitive silver salt disposed in the aqueous dispersion, is preferably, 1 mole % or less, more preferably, 0.1 mole % or less per one mol of the organic acid silver salt in the solution. More preferable still is that photosensitive silver salt is not positively added.

It is possible to manufacture the photothermographic material of the invention by mixing together an aqueous dispersion liquid of the organic silver salt and an aqueous dispersion liquid of the photosensitive silver salt, and whilst the mixing ratio of the organic silver salt and the photosensitive silver salt is selected according to the application, it is preferable that the proportion of the photosensitive silver salt to the organic silver salt is between 1 mole % and 30 mole %. More preferable between 2 mole % and 20 mole % and the range of 3 mole % to 15 mole % is particularly favorable. When mixing, in order to adjust the photographic characteristics, there is the favorable method of mixing two or more types of organic silver salt aqueous dispersion liquids with two or more types of photosensitive silver salt aqueous dispersion liquids.

As methods for dispersing the organic acid silver of the invention, as well as the above the following are also relevant: Japanese Patent Application Laid-Open (JP-A) Nos. 10-62899, 11-349591, 2000-7683, 2000-72711, 2001-163889, 2001-163890, 2001-163827, 2001-33907, 2001-188313, 2001-83652, 2002-6442, 2002-49117, 2002-31870 and 2002-107868, and European Patent Publication Nos. 0803763A1, and 0962812A1.

4) Addition Amount

While an organic silver salt in the invention can be used in a desired amount, a total coating amount of Ag including silver halide is preferably in the range from 0.1 $g/m^2$ to 5.0 $g/m^2$, more preferably 0.3 $g/m^2$ to 3.0 $g/m^2$, and further preferably 0.5 $g/m^2$ to 2.0 $g/m^2$. Particularly, it is preferred that a total coating amount of silver preferably is 1.8 $g/m^2$ or less, and more preferably from 1.6 $g/m^2$ or less, to improve the image stability. Using the preferable reducing agent of the invention, it is possible to obtain a sufficient image density even with such a low amount of silver.

(Reducing Agent)

The photothermographic material of the invention includes a thermal developer of a reducing agent for the organic silver salt. The reducing agent of the invention is preferably a phenolic hydroxyl group with a substituent in the ortho position to the hydroxyl group, that is a hindered phenolic reducing agent, or bisphenolic reducing agent. A compound represented by Formula (R) below is particularly preferable.

Formula R

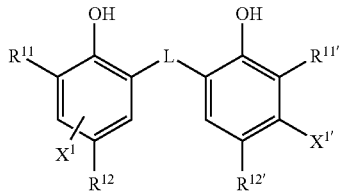

In formula (R), $R^{11}$ and $R^{11'}$ each independently represent an alkyl group, and at least one is a secondary or tertiary alkyl group. $R^{12}$ and $R^{12'}$ each independently represent a hydrogen atom or a group capable of substituting for a hydrogen atom on a benzene ring. L represents a —S— group or a —$CHR^{13}$—group. $R^{13}$ represents a hydrogen atom or an alkyl group. $X^1$ and $X^{1'}$ each independently represent a hydrogen atom or a group capable of substituting for a hydrogen atom on a benzene ring.

Formula (R) will be described hereinafter in detail.

Hereinafter, the term "alkyl group" includes cycloalkyl groups, unless otherwise specified.

1) $R^{11}$ and $R^{11'}$ $R^{11}$ and $R^{11'}$ each independently represent a substituted or unsubstituted alkyl group having 1 to 20 carbon atoms, with at least one being a secondary or tertiary alkyl group. Substituents for the alkyl group have no particular restriction but preferably include an aryl group, hydroxy group, alkoxy group, aryloxy group, alkylthio group, arylthio group, acylamino group, sulfoneamide group, sulfonyl group, phosphoryl group, acyl group, carbamoyl group, ester group, ureido group, urethane group and halogen atom.

2) $R^{12}$ and $R^{12'}$, $X^1$ and $X^{1'}$ $R^{12}$ and $R^{12'}$ each independently represent a hydrogen atom or a group capable of substituting for a hydrogen atom on a benzene ring. $X^1$ and $X^{1'}$ each independently represent a hydrogen atom or a group capable of substituting for a hydrogen atom on a benzene ring. Each of the groups capable of substituting for a hydrogen atom on the benzene ring preferably include an alkyl group, aryl group, halogen atom, alkoxy group, and acylamino group.

3) L

L represents a —S— group or a —$CHR^{13}$— group. $R^{13}$ represents a hydrogen atom or an alkyl group having 1 to 20 carbon atoms in which the alkyl group may have a substituent. Specific examples of non-substituted alkyl groups for $R^{13}$ include, for example, methyl group, ethyl group, propyl group, butyl group, heptyl group, undecyl group, isopropyl group, 1-ethylpentyl group, 2,4,4-trimethylpentyl group, cyclohexyl group, 2,4-dimethyl-3-cyclohexenyl group, and 3,5-dimethyl-3-cyclohexenyl group. Examples of substituents for the alkyl group include, like the substituents of $R^{11}$, a halogen atom, an alkoxy group, alkylthio group, aryloxy group, arylthio group, acylamino group, sulfoneamide group, sulfonyl group, phosphoryl group, oxycarbonyl group, carbamoyl group, and sulfamoyl group.

4) Preferred Substituents $R^{11}$ and $R^{11'}$ are, preferably, secondary or tertiary alkyl groups having 1 to 15 carbon atoms and can include, specifically, isopropyl group, t-butyl group, t-amyl group, t-octyl group, cyclohexyl group, cyclopentyl group, 1-methylcyclohexyl group, and 1-methylcyclopropyl group. $R^{11}$ and $R^{11'}$ each represent, more preferably a t-butyl group, t-amyl group, 1-methyl cyclohexyl group, t-butyl group being most preferred.

$R^{12}$ and $R^{12'}$ are, preferably, an alkyl group having 1 to 20 carbon atoms and can include, specifically, a methyl group, ethyl group, propyl group, butyl group, isopropyl group, t-butyl group, t-amyl group, cyclohexyl group, 1-methylcyclohexyl group, benzyl group, methoxymethyl group and methoxyethyl group. More preferred are a methyl group, ethyl group, propyl group, isopropyl group, and t-butyl group.

$X^1$ and $X^{1'}$ are, preferably, a hydrogen atom, a halogen atom, or an alkyl group, and more preferably, a hydrogen atom.

L is preferably a Group —$CHR'^3$—.

$R^{13}$ is, preferably, a hydrogen atom or an alkyl group having 1 to 15 carbon atoms. As the alkyl group, linear alkyl groups and cycloalkyl groups are preferably used. Alkyl groups having a C═C group in the molecule are also preferably used. Preferable alkyl groups include methyl group, ethyl group, propyl group, isopropyl group, 2,4,4-trimethylpentyl group, cyclohexyl group, 2,4-dimethyl-3-cyclohexenyl group, and 3,5-dimethyl-3-cyclohexenyl group. Particularly preferred $R^{13}$ is a hydrogen atom, methyl group, ethyl group, propyl group, isopropyl group, and 2,4-dimethyl-3-cyclohexenyl group. Particularly preferable R13 group includes a hydrogen atom, methyl group, ethyl group, propyl group, isopropyl group and 2,4-dimethyl-3-cyclohexenyl group.

When $R^{11}$, $R^{11'}$ are tertiary alkyl groups and $R^{12}$, $R^{12'}$ are methyl groups, then it is preferable that $R^{13}$ is a primary or secondary alkyl group with between 1 and 8 carbon atoms (such as methyl, ethyl, propyl, isopropyl, 2,4-dimethyl-3-cyclohexenyl group).

When $R^{11}$, $R^{11'}$ are tertiary alkyl groups and $R^{12}$, $R^{12'}$ are alkyl groups which are not methyl, then it is preferable that $R^{13}$ is a hydrogen atom.

When $R^{11}$, $R^{11'}$ are not tertiary alkyl groups it is preferable that $R^{13}$ is a hydrogen atom or a secondary alkyl group, and a secondary alkyl group is particularly preferable. Preferable secondary alkyl groups for $R^{13}$ are an isopropyl group and a 2,4-dimethyl-3-cyclohexenyl group.

The reducing agents described above show different thermal developing performances and developed-silver tones or the like depending on the combination of $R^{11}$, $R^{11'}$, $R^{12}$, $R^{12'}$, and $R^{13}$. Since these performances can be controlled by using two or more kinds of reducing agents at various mixing ratios, it is preferred to use two or more kinds of reducing agents in combination depending on the purpose.

Specific examples of the reducing agents of the invention including the compounds represented by Formula (R) according to the invention are shown below, but the invention is not restricted to them.

R1-1

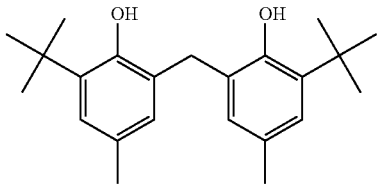

-continued
R1-2
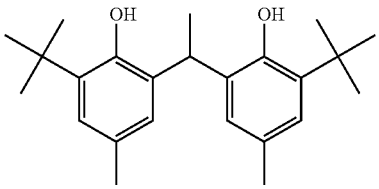
R1-3
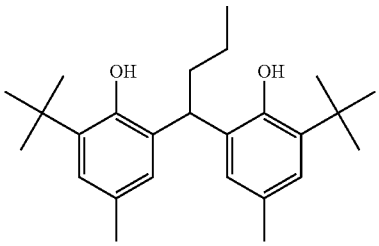
R1-4
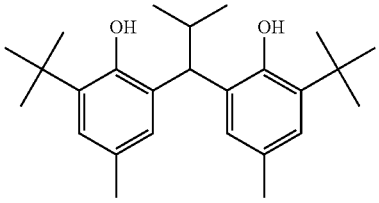
R1-5
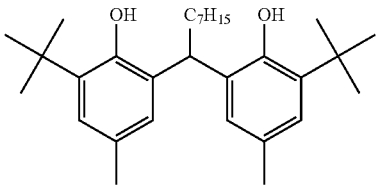
R1-6
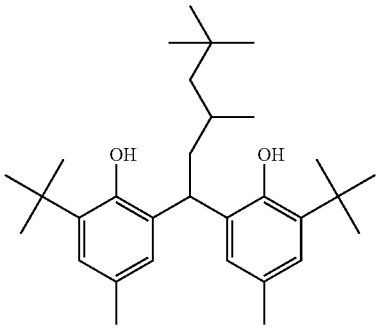
R1-7
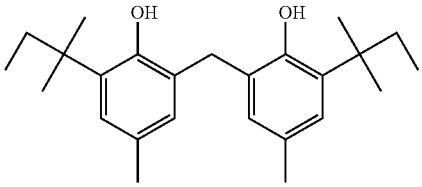
R1-8
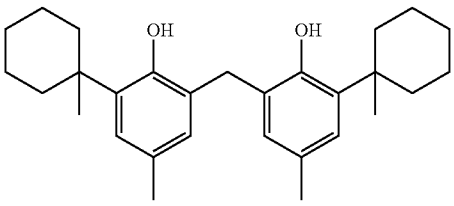
-continued
R1-9
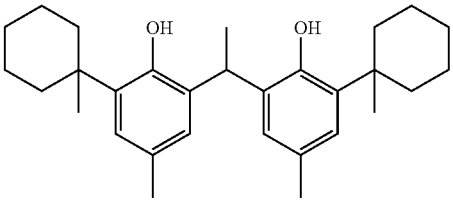
R1-10
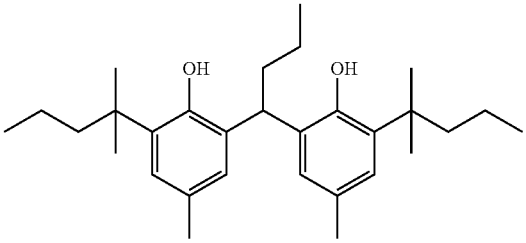
R1-11
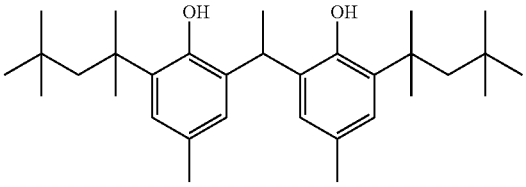
R1-12
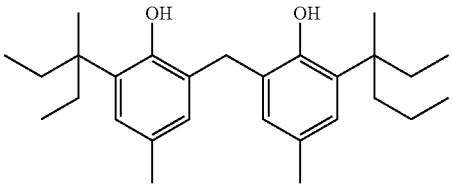
R1-13
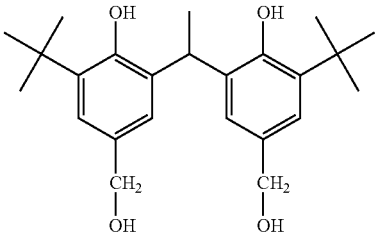
R1-14
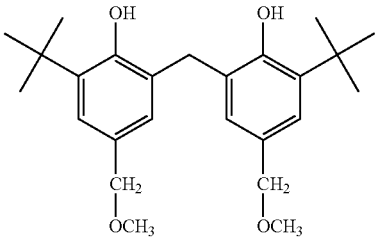

-continued
R1-15
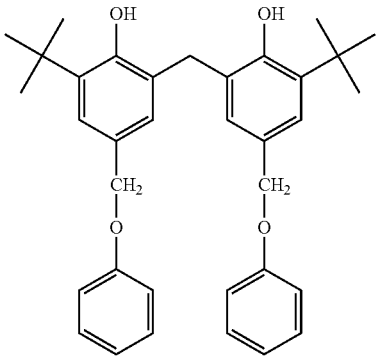
R1-16
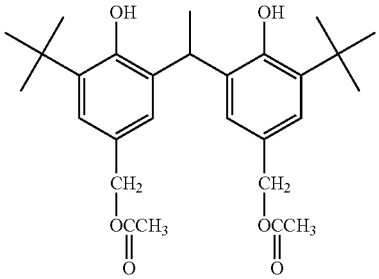
R1-17
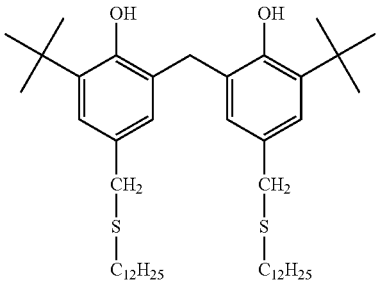
R1-18
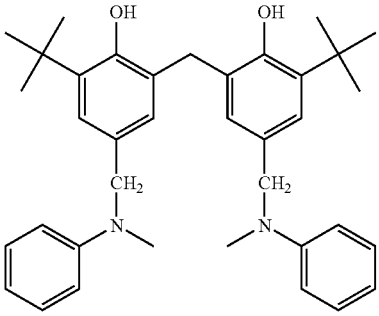
R1-19
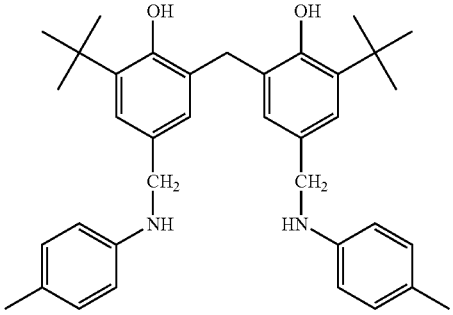
-continued
R1-20
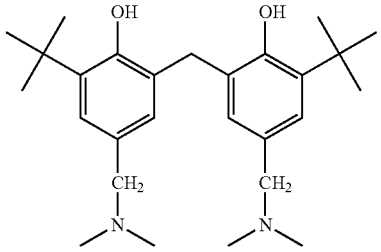
R1-21
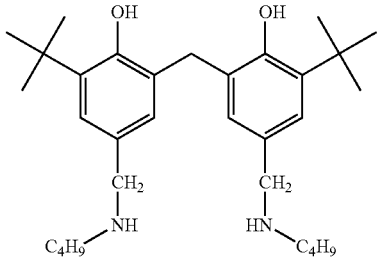
R1-22
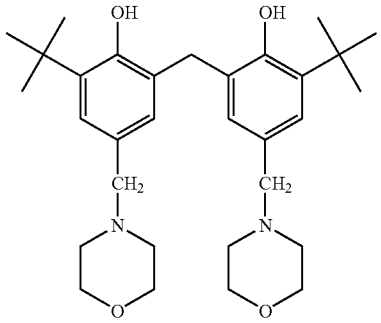
R1-23
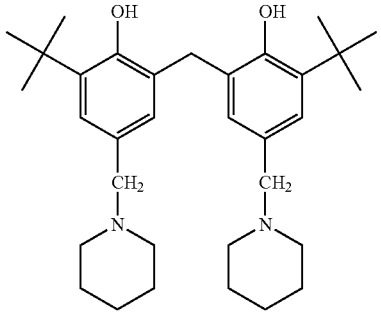
R1-24
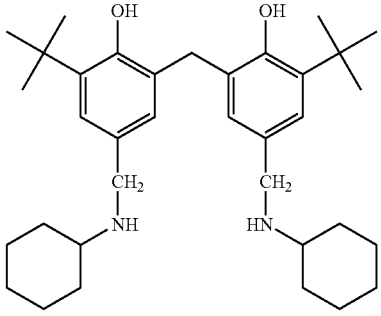

-continued
R1-25
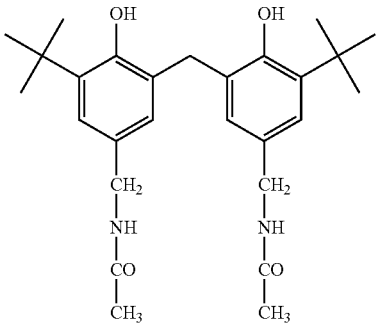
R1-26
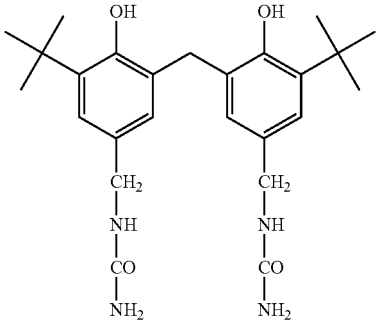
R1-27
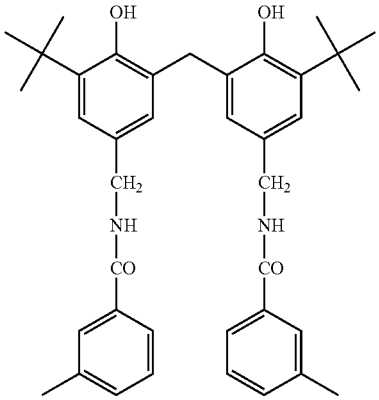
R1-28
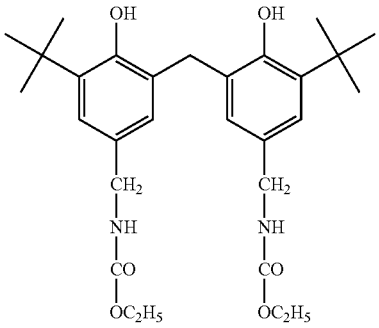
-continued
R1-29
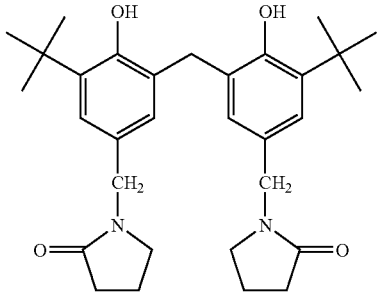
R1-30
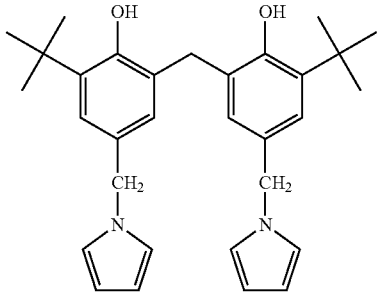
R1-31
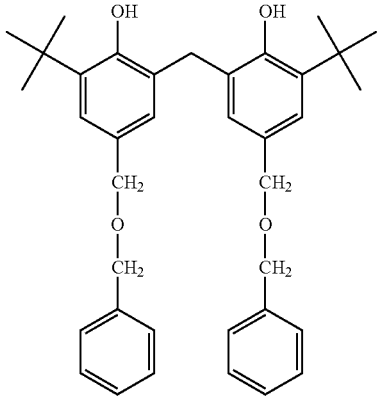
R1-32
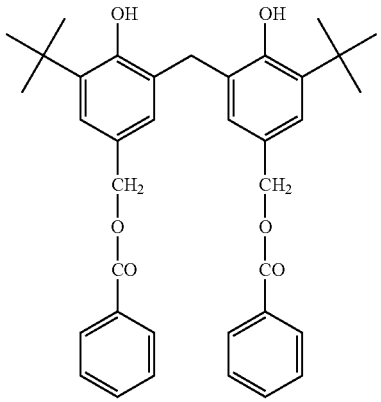

-continued

R1-33

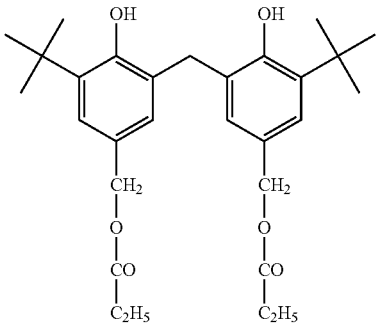

R1-34

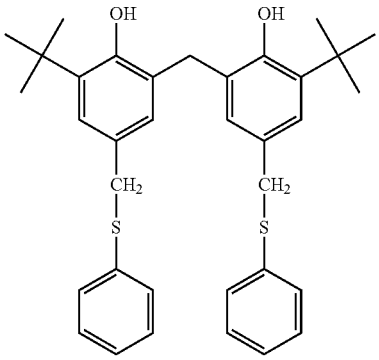

R1-35

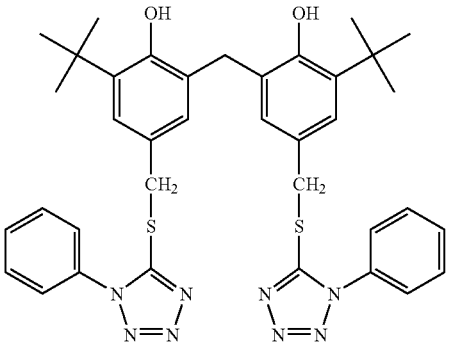

R1-36

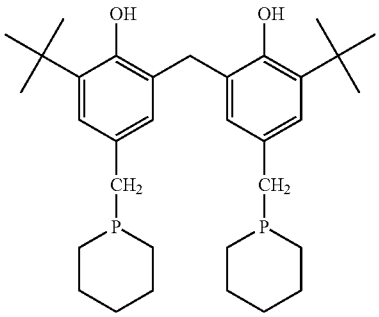

As preferred reducing agents of the invention other than those above, there can be mentioned compounds disclosed in JP-A Nos. 2001-188314, 2001-209145, 2001-350235, and 2002-156727 and EP 1278101A2.

In the invention, the addition amount of the reducing agent is, preferably, from 0.1 g/m$^2$ to 3.0 g/m$^2$, more preferably, 0.2 g/m$^2$ to 2.0 g/m$^2$ and, further preferably 0.3 g/m$^2$ to 1.0 g/m$^2$. It is, preferably, contained in a range of 5 mole % to 50 mole % per one mole of silver in the image forming layer, more preferably, 8 mole % to 30 mole % and, further preferably, 10 mole % to 20 mole %.

The reducing agent can be contained in any of the layers on the side of the image forming layer, but is preferably contained in the image forming layer.

In the invention, the reducing agent may be incorporated into photothermographic material by being added into the coating solution, such as in the form of a solution, an emulsion dispersion, a solid fine particle dispersion, and the like.

Well known emulsion dispersion methods which can be used are dissolving oils such as dibutyl phthalate, tricresyl phosphate, dioctyl sebacate, or tri(2-ethylhexyl) phosphate, using auxiliary solvents such as ethyl acetate and cyclohexanone, adding a surfactant such as sodium dodecyl benzene sulphonate, sodium oleoyl-N-methyl taurate, and sodium di(2-ethylhexyl) sulfosuccinate, and then mechanically manufacturing the emulsion dispersion. Here, in order to adjust the viscosity and refractive index of the oil drops it is preferable to add polymers such as alpha methyl styrene oligomer and poly (t-butylacrylamide).

As solid fine particle dispersion method, there can be mentioned a method comprising dispersing the powder of the reducing agent in a proper medium such as water, by means of a ball mill, colloid mill, vibrating ball mill, sand mill, jet mill, roller mill, or ultrasonics, thereby obtaining a solid dispersion. In this case, there can also be used a protective colloid (such as polyvinyl alcohol), or a surfactant (for instance, an anionic surfactant such as sodium triisopropylnaphthalenesulfonate (a mixture of compounds having the three isopropyl groups in the different substitution sites)). In the mills enumerated above, generally used as the dispersion media are beads made of zirconia and the like, and Zr and the like eluting from the beads may be incorporated in the dispersion. Although it depends on the dispersing conditions, the amount of Zr and the like incorporated in the dispersion is generally in the range from 1 ppm to 1000 ppm. It is practically acceptable so long as Zr is incorporated in an amount of 0.5 mg or less per 1 g of silver. Preferably, a preservative (for instance, sodium benzoisothiazolinone salt) is added in the water dispersion.

In the invention, furthermore, the reducing agent is preferably used as a solid particle dispersion, and the reducing agent is added in the form of fine particles having average particle size from 0.01 μm to 10 μm, and more preferably, from 0.05 μm to 5 μm, and further preferably, from 0.1 μm to 2 μm. In the invention, other solid dispersions are preferably used with this particle size range.

Description of Development Accelerator

In the photothermographic material of the invention, a development accelerator is preferably added. A preferable development accelerator in the case of addition is a sulfonamidephenol compound represented by the general formula (A) in JP-A Nos. 2000-267222 and 2000-330234, a hindered phenol compound represented by the general formula (II) in JP-A No. 2001-92075, a hydrazine compound represented by the general formula (I) in JP-A Nos. 10-62895 and 11-15116, by the general formula (D) in JP-A No. 2002-156727 and by the general formula (1) in JP-A No. 2002-278017, or a phenol or naphthol compound represented by the general formula (2) in JP-A No. 2001-264929. A phenol compound described in JP-A Nos. 2002-311533 and 2002-341484 is also preferred. In particular, a naphthol compound described in JP-A No. 2003-66558 is preferred. Such a development accelerator is used within a range of 0.1 to 20 mole % with respect to the reducing agent, preferably 0.5 to 10 mole % and more preferably 1 to 5 mole %. It can be introduced into the photosensitive material by methods similar to those for the reducing agent, but it is particularly preferably added as a solid dispersion or an emulsified dispersion. In the case of addition as an emulsified dispersion, the addition is preferably made as an emulsified dispersion prepared with a high-boiling solvent which is solid at the normal temperature and a low-boiling auxiliary solvent, or as so-called oil-less emulsified dispersion without utilizing the high-boiling solvent.

In the invention, among the aforementioned development accelerators, more preferred are hydrazine compounds described in JP-A Nos. 2002-156727 and 2002-278017, and naphthol compounds described in JP-A No. 2003-66558.

In the invention, particularly preferred development accelerators are compounds represented by the following formulas (A-1) and (A-2).

$Q_1$—NHNH—$Q_2$ Formula (A-1)

In the formula, $Q_1$ represents an aromatic group or a heterocyclic group bonded at a carbon atom to —NHNH—$Q_2$; and $Q_2$ represents a carbamoyl group, an acyl group, an alkoxycarbonyl group, an aryloxycarbonyl group, a sulfonyl group or a sulfamoyl group.

In Formula (A-1), the aromatic group or the heterocyclic group represented by $Q_1$ is preferably a 5- to 7-membered unsaturated ring. Preferred examples include a benzene ring, a pyridine ring, a pyradine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring and a thiophene ring, and there is also preferred a condensed ring formed by mutual condensation of these rings.

These rings may have a substituent, and, in the case two or more substituents are present, such substituents may be mutually the same or different. Examples of the substituent include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group and an acyl group. In the case such substituent is a substitutable group, it may further have a substituent, and examples of preferred substituent include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, and a sulfamoyl group.

A carbamoyl group represented by $Q_2$ preferably has 1 to 50 carbon atoms, more preferably 6 to 40 carbon atoms, and can be, for example, non-substituted carbamoyl, methylcarbamoyl, N-ethyl carbamoyl, N-propylcarbamoyl, N-sec-butylcarbamoyl, N-octylcarbamoyl, N-cyclohexyl carbamoyl, N-tert-butylcarbamoyl, N-dodecylcarbamoyl, N-(3-dodecyloxypropyl)carbamoyl, N-octadecyl carbamoyl, N-{3-(2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxyl carbonylphenyl) carbamoyl, N-naphthylcarbamoyl, N-3-pyridylcarbamoyl, or N-benzylcarbamoyl.

An acyl group represented by $Q_2$ preferably has 1 to 50 carbon atoms, more preferably 6 to 40 carbon atoms, and can be, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxy benzoyl, or 2-hydroxymethylbenzoyl. An alkoxycarbonyl group represented by $Q_2$ preferably has 2 to 50 carbon atoms, more preferably 6 to 40 carbon atoms, and can be, for example, methoxy carbonyl, ethoxycarbonyl, isobutyloxycarbonyl, cyclohexyloxycarbonyl, dodecyloxy carbonyl or benzyloxycarbonyl.

An aryloxycarbonyl group represented by $Q_2$ preferably has 7 to 50 carbon atoms, more preferably 7 to 40 carbon atoms, and can be, for example, phenoxycarbonyl, 4-octyloxyphenoxy carbonyl, 2-hydroxymethylphenoxycarbonyl, or 4-dodecyloxyphenoxycarbonyl. A sulfonyl group represented by $Q_2$ preferably has 1 to 50 carbon atoms, more preferably 6 to 40 carbon atoms, and can be, for example, methylsulfonyl, butylsulfonyl, octylsulfonyl, 2-hexadecylsulfonyl, 3-dodecyloxypropylsulfonyl, 2-octyloxy-5-tert-octylphenylsulfonyl or 4-dodecyloxyphenylsulfonyl.

A sulfamoyl group represented by $Q_2$ preferably has 0 to 50 carbon atoms, more preferably 6 to 40 carbon atoms, and can be, for example, non-substituted sulfamoyl, N-ethylsulfamoyl, N-(2-ethylhexyl) sulfamoyl, N-decylsulfamoyl, N-hexadecylsulfamoyl, N-{3-(2-ethylhexyloxy) propyl}sulfamoyl, N-(2-chloro-5-dodecyloxycarbonylphenyl) sulfamoyl, or N-(2-tetradecyloxyphenyl)sulfamoyl. A group represented by $Q_2$ may further have, in a substitutable position, a group cited before as a substituent group for a 5- to 7-membered unsaturated ring represented by $Q_1$, and, in the case two or more substituents are present, they may be mutually the same or different.

In the following there will be explained a preferred range of the compound represented by Formula (A-1). For $Q_1$, there is preferred a 5- or 6-membered unsaturated ring, and more preferred is a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isooxazole ring or a ring formed by a condensation of the foregoing ring with a benzene ring or an unsaturated hetero ring. Also for $Q_2$, there is preferred a carbamoyl group, more preferably a carbamoyl group having a hydrogen atom on a nitrogen atom.

Formula (A-2)

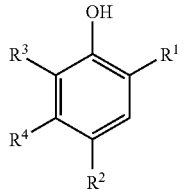

In formula (A-2), $R_1$ represents one selected from an alkyl group, an acyl group, an acylamino group, a sulfoneamide group, an alkoxycarbonyl group, and a carbamoyl group. $R_2$ represents one selected from a hydrogen atom, a halogen atom, an alkyl group, an alkoxy group, an aryloxy group, an alkylthio group, an arylthio group, an acyloxy group, and a carbonate ester group. $R_3$ and $R_4$ each represent a group capable of substituting for a hydrogen atom on a benzene ring which is mentioned as the example of the substituent for formula (A-1). $R_3$ and $R_4$ may bond together to form a condensed ring.

$R_1$ is, preferably, one selected from the following groups having 1 to 20 carbon atoms, namely, those are an alkyl group (for example, methyl group, ethyl group, isopropyl group, butyl group, tert-octyl group, or cyclohexyl group), an acylamino group (for example, acetylamino group, benzoylamino group, methylureido group, or 4-cyanophenylureido group), and a carbamoyl group (for example, n-butylcarbamoyl group, N,N-diethylcarbamoyl group, phenylcarbamoyl group, 2-chlorophenylcarbamoyl group, or 2,4-dichlorophenylcarbamoyl group). Among them, an acylamino group (including ureido group or urethane group) is more preferred.

$R_2$ is preferably one of a halogen atom (more preferably, chlorine atom, bromine atom), an alkoxy group (for example, methoxy group, butoxy group, n-hexyloxy group, n-decyloxy group, cyclohexyloxy group or benzyloxy group), and an aryloxy group (for example, phenoxy group or naphthoxy group).

$R_3$ preferably is one of a hydrogen atom, a halogen atom, and an alkyl group having 1 to 20 carbon atoms, and most preferably a halogen atom. $R_4$ is preferably one of a hydrogen atom, alkyl group, and an acylamino group, and more preferably one of an alkyl group and an acylamino group. Examples of the preferred substituent thereof are identical with those for $R_1$. In a case where $R_4$ is an acylamino group, $R_4$ may preferably bond with $R_3$ to form a carbostyryl ring.

In a case where $R_3$ and $R_4$ in formula (A-2) link together to form a condensed ring, a naphthalene ring is particularly preferred as the condensed ring. The same substituents as the example of the substituents referred to for formula (A-1) may bond to the naphthalene ring. In a case where formula (A-2) is a naphtholic compound, $R_1$, is, preferably, a carbamoyl group. Among them, benzoyl group is particularly preferred. $R_2$ is, preferably, one of an alkoxy group and an aryloxy group and, particularly preferably an alkoxy group. Preferred specific examples for the development accelerator of the invention are to be described below. The invention is not restricted to them.

(A-1)

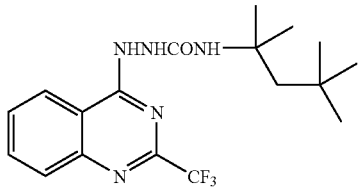

(A-2)

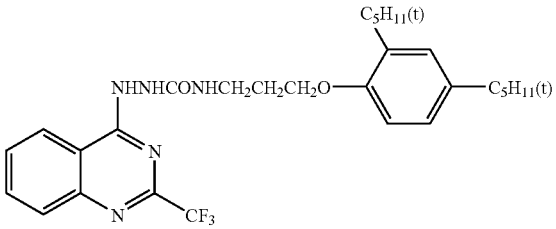

(A-3)

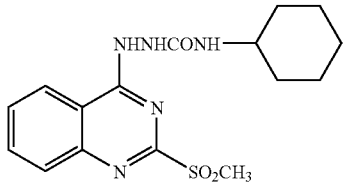

(A-4)

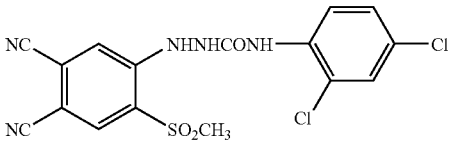

(A-5)

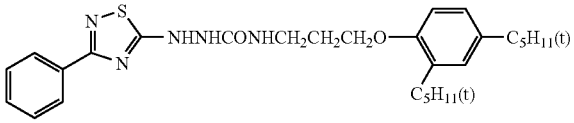

-continued (A-6)

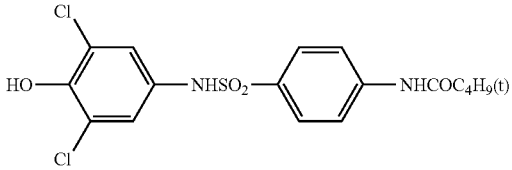

(A-7)

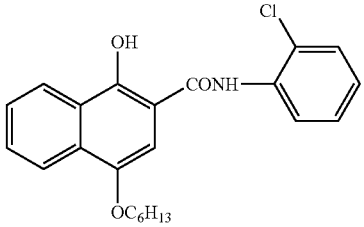

(A-8)

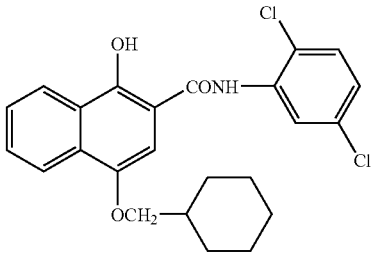

(A-9)

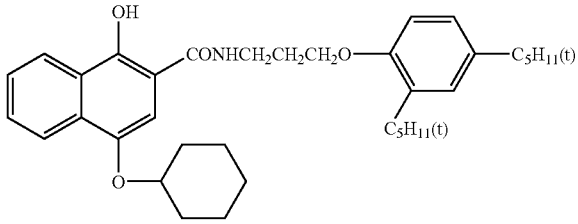

(A-10)

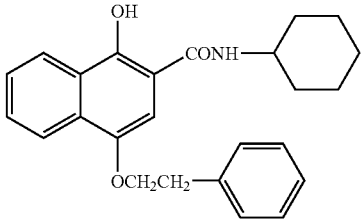

(A-11)

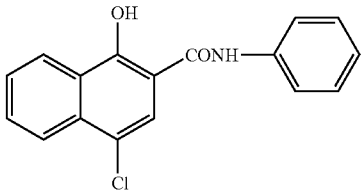

(A-12)

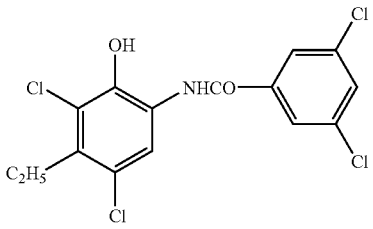

(Description of Hydrogen Bonding Compound)

In the invention, in the case where the reducing agent has an aromatic hydroxy group (—OH) or an amino group (—NHR, R is a hydrogen atom or an alkyl group), particularly in the case where the reducing agent is a bisphenol described above, it is preferred to use a non-reducing compound having a group capable of reacting with these groups of the reducing agent, and that is also capable of forming a hydrogen bond in combination therewith.

As a group forming a hydrogen bond with a hydroxy group or an amino group, there can be mentioned a phosphoryl group, a sulfoxide group, a sulfonyl group, a carbonyl group, an amide group, an ester group, an urethane group, an ureido group, a tertiary amino group, a nitrogen-containing aromatic group, and the like. Preferred among them is phosphoryl group, sulfoxide group, amide group (not having >N—H moiety but being blocked in the form of >N-Ra (where, Ra represents a substituent other than H)), urethane group (not having >N—H moiety but being blocked in the form of >N-Ra (where, Ra represents a substituent other than H)), and ureido group (not having >N—H moiety but being blocked in the form of >N-Ra (where, Ra represents a substituent other than H)).

In the invention, particularly preferable as the hydrogen bonding compound is the compound expressed by formula (D) shown below.

Formula (D)

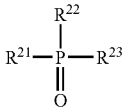

In formula (D), $R^{21}$ to $R^{23}$ each independently represent one selected from an alkyl group, an aryl group, an alkoxy group, an aryloxy group, an amino group, and a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, t-butyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, 2-phenoxypropyl group, and the like.

As an aryl group, there can be mentioned phenyl group, cresyl group, xylyl group, naphthyl group, 4-t-butylphenyl group, 4-t-octylphenyl group, 4-anisidyl group, 3,5-dichlorophenyl group, and the like.

As an alkoxyl group, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like. As an aryloxy group, there can be mentioned phenoxy group, cresyloxy group, isopropylphenoxy group, 4-t-butylphenoxy group, naphthoxy group, biphenyloxy group, and the like.

As an amino group, there can be mentioned are dimethylamino group, diethylamino group, dibutylamino group, dioctylamino group, N-methyl-N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

(D-1)

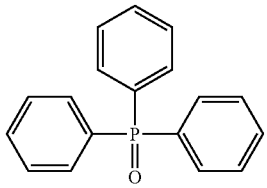

(D-2)

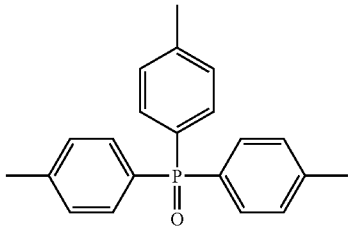

(D-3)

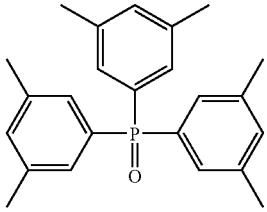

(D-4)

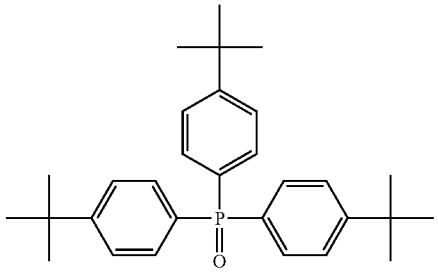

(D-5)

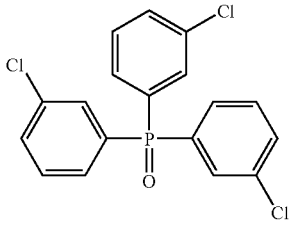

-continued (D-6)

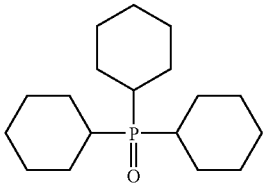

(D-7)

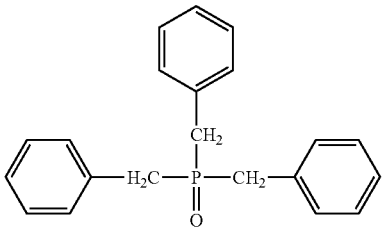

(D-8)

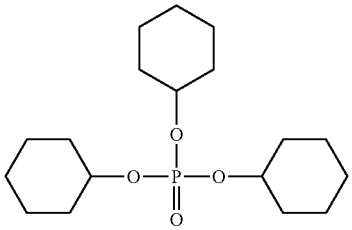

(D-9)

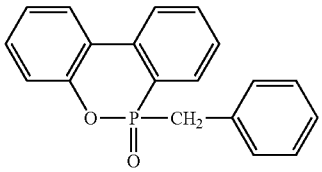

(D-10)

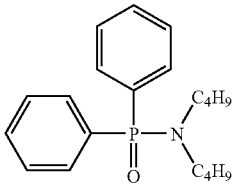

(D-11)

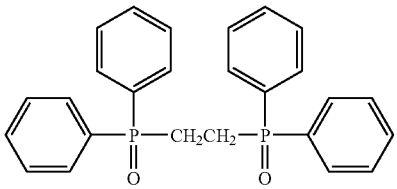

(D-12)

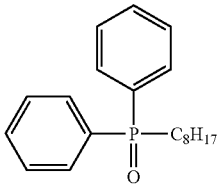

(D-13)

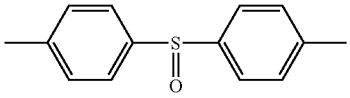

-continued (D-14)

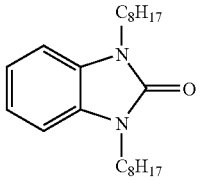

(D-15)

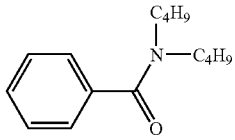

Other than the above, examples of hydrogen bonding compounds are described in European Patent No. 1096310, and JP-A Nos. 2002-156727, and 2002-318431.

The hydrogen bonding compound of the invention shown in formula (D) can be used in the photothermographic material by being incorporated into the coating solution in the form of a solution, emulsion dispersion, or solid fine particle dispersion, in a similar way to the reducing agent, but it is preferably used as a solid dispersion. In the solution, the hydrogen bonding compound of the invention forms a hydrogen-bonded complex with a compound having a phenolic hydroxy group, amino group, and can be isolated as a complex in a crystalline state depending on the combination of the reducing agent and the compound expressed by formula (D).

It is particularly preferred to use the crystal powder thus isolated in the form of a solid fine particle dispersion, because it provides stable performance. Further, it is also preferred to use a method of forming a complex during dispersion by mixing the reducing agent and the compound represented by formula (D) of the invention in the form of powders and dispersing them with an appropriate dispersing agent using a sand grinder mill and the like.

The hydrogen bonding compound of the invention as shown in formula (D) is preferably used in the range from 1 mole % to 200 mole % with respect to the reducing agent, more preferably from 10 mole % to 150 mole %, and further preferably, from 20 mole % to 100 mole %.

(Description of Photosensitive Silver Halide)

1) Halogen Composition

The halide composition of the photosensitive silver halide of the present invention is not specifically limited, and silver chloride, silver chlorobromide, silver bromide, silver iodobromide, silver iodochlrobromide or silver iodide can be used. Among these silver halides, silver bromide, silver iodobromide, or silver iodide are preferable. The distribution of the halogen composition in a grain may be uniform or the halogen composition may be changed stepwise, or it may be changed continuously. Further, a silver halide grain having a core/shell structure can be preferably used. Preferred structure is a two- to five-fold structure and, more preferably, core/shell grain having a two- to four-fold structure can be used. A technique in which in there is silver bromide or silver iodide localized at the surface of silver chloride, silver bromide, or silver chorobromide particles can be used.

2) Method of Grain Formation

The method of forming photosensitive silver halide is well-known in the relevant art and, for example, methods described in Research Disclosure No. 17029, June 1978, and U.S. Pat. No. 3,700,458 can be used. Specifically, a method of preparing a photosensitive silver halide by adding a silver-supplying compound and a halogen-supplying compound to a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide grains is preferably small, in order to suppress white cloudiness after forming images, specifically, 0.20 μm or less, preferably 0.01 μm to 0.15 μm, more preferably 0.02 μm to 0.12 μm. The term "grain size" herein, refers to a grain diameter of a circular image area having an area equivalent to a projected area of a silver halide grain (in the case of a tabular grain, the projected area of the main plane).

4) Grain Form

While examples of forms of silver halide grains in the invention are cubic grains, octahedral grains, tabular grains, spherical grains, rod-like grains, potato-like grains and the like, particularly preferable in the invention are cubic grains. Grains obtained by rounding corners of silver halide grains can also be preferably used. The surface index (Miller index) of the outer surface of a photosensitive silver halide particle is not particularly restricted, and it is preferable that the ratio occupied by the [100] surface is high, because of showing high spectral sensitization efficiency when a spectral sensitizer is adsorbed. The ratio is preferably 50% or more, more preferably 65% or more, further preferably 80% or more. The ratio of the [100] surface, Miller index, can be determined by a method described in T. Tani; J. Imaging Sci., 29, 165 (1985) utilizing adsorption dependency of the [111] surface and [100] surface in adsorption of a sensitizing dye.

5) Heavy Metal

The photosensitive silver halide grain of the invention can contain metals or complexes of metals belonging to groups 6 to 13 of the periodic table (one showing groups 1 to 18). The metals or metal complex from groups 6 to 10 of the periodic table are preferably included. Preferable examples of metals or central metals of metal complexes from groups 6 to 13 are rhodium, ruthenium, iridium and iron. The metal complex may be used alone, or two or more kinds of complexes comprising identical or different species of metals may be used together. A preferred content is in the range from $1\times10^{-9}$ mole to $1\times10^{-3}$ mole per 1 mole of silver. The heavy metals, metal complexes and the adding method thereof are described in JP-A No. 7-225449, in paragraphs 0018 to 0024 of JP-A No.11-65021 and in paragraphs 0227 to 0240 of JP-A No. 11-119374.

In the present invention, a silver halide grain having a hexacyano metal complex that is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$.

In the invention, Fe hexacyano complex is preferred.

Since hexacyano complexes exists in ionic form in an aqueous solution, the paired cations are not important but alkali metal ions, such as sodium ion, potassium ion, rubidium ion, cesium ion and lithium ions; ammonium ion, alkyl ammonium ions (for example, tetramethyl ammonium ion, tetraethyl ammonium ion, tetrapropyl ammonium ion, and tetra(n-butyl) ammonium ion), which are easily miscible with water and suitable to precipitating action of a silver halide emulsion are preferably used.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mole to $1\times10^{-2}$ mole per 1 mole of silver, and more preferably from $1\times10^{-4}$ mole to 1×10–3 mole per 1 mole of silver.

In order to make the hexacyano metal complex be present on the outermost surface of a silver halide grain, the hexacyano metal complex is directly added in any of the following stages: after completion of addition of an aqueous solution of silver nitrate used for grain formation; before completion of an emulsion formation step prior to a chemical sensitization step, of conducting chalcogen sensitization such as sulfur sensitization, selenium sensitization and tellurium sensitization or noble metal sensitization such as gold sensitization; during washing; during dispersing; or immediately before chemical sensitization. In order not to grow the fine silver halide grains, the hexacyano metal complex is preferably rapidly added after the grain is formed, and it is preferably added before completion of the emulsion formation step.

Addition of the hexacyano complex may be started after addition of 96% by mass of an entire amount of silver nitrate to be added for grain formation, more preferably started after addition of 98% by mass and, particularly preferably, started after addition of 99 by mass.

When any of the hexacyano metal complex is added after addition of aqueous silver nitrate just before completion of grain formation, it can be adsorbed to the outermost surface of the silver halide grain and most of them form an insoluble salt with silver ions on the surface of the grain. Since silver hexacyanoferrate (II) is a less soluble salt than AgI, redissolution with fine grains can be prevented and fine silver halide grains with smaller grain size can be prepared.

Metal atoms that can be contained in the silver halide grain used in the invention (for example, $[Fe(CN)_6]^{4-}$), desalting methods of a silver halide emulsion, and chemical sensitizing methods are described in paragraph Nos. 0046 to 0050 of JP-A No.11-84574, in paragraph Nos. 0025 to 0031 of JP-A No. 11-65021, and paragraph Nos. 0242 to 0250 of JP-A No. 11-119374.

6) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and low molecular weight gelatin having a molecular weight of 10,000 to 1,000,000 is preferably used. And phthalated gelatin is also preferably used. These gelatins may be used at grain formation or at the time of dispersion after desalting treatment but they are preferably used during grain formation.

7) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or two or more of them may be used in combination. In the invention, sensitizing dye can be added into the silver halide emulsion preferably after desalting and before coating, and more preferably after desalting and before completion of chemical ripening.

In the invention, the sensitizing dye may be added at any amount according to sensitivity and fogging properties, but it is preferably added from $10^{-6}$ mole to 1 mole, and more preferably from $10^{-4}$ mole to $10^{-1}$ mole, per 1 mole of silver halide in the image forming layer.

The photothermographic material of the invention may also contain super sensitizers in order to improve spectral sensitizing effect. The super sensitizers usable in the invention can include those compounds described in EP-A No. 587338, U.S. Pat. Nos. 3,877,943 and 4,873,184 and JP-A Nos. 5-341432, 11-109547, and 10-111543.

8) Chemical Sensitization

The photosensitive silver halide grain in the invention is preferably chemically sensitized by sulfur sensitizing method, selenium sensitizing method or tellurium sensitizing method. As the compound used preferably for sulfur sensitizing method, selenium sensitizing method and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are more preferred.

The photosensitive silver halide grain in the invention is preferably chemically sensitized by gold sensitizing method alone or in combination with the chalcogen sensitization described above. As the gold sensitizer, those having a oxidation number of gold of either +1 or +3 are preferred and those gold compounds usually used as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization and (4) just before coating.

The amount of sulfur, selenium and tellurium sensitizer used in the invention may vary depending on the silver halide grain used, the chemical ripening conditions and the like but it is used at about $10^{-8}$ mole to $10^{-2}$ mole per 1 mole of silver halide, preferably, $10^{-7}$ mole to $10^{-3}$ mole.

The addition amount of the gold sensitizer may vary depending on various conditions but it is generally about $10^{-7}$ mole to $10^{-3}$ mole and, more preferably, $10^{-6}$ mole to $5\times10^{-4}$ mole 1 mole of silver halide.

There is no particular restriction on the condition for the chemical sensitization in the invention but, approximately, the pH is 5 to 8, pAg is 6 to 11 and temperature is at 40° C. to 95° C.

In the silver halide emulsion used in the invention, a thiosulfonic acid compound may be added by the method shown in EP-A No. 293917.

A reduction senstitizer is used preferably for the photosensitive silver halide grain in the invention. As the specific compound for the reduction sensitization, ascorbic acid or amino imino methane sulfinic acid is preferred, as well as use of stannous chloride, hydrazine derivatives, borane compounds, silane compounds and polyamine compounds are preferred. The reduction sensitizer may be added at any stage in the photosensitive emulsion production process from crystal growth to the preparation step just before coating. Further, it is preferred to apply reduction sensitization by ripening while keeping pH to 7 or higher or pAg to 8.3 or lower for the emulsion, and it is also preferred to apply reduction sensitization by introducing a single addition portion of silver ions during grain formation.

9) Combined Use of a Plurality of Silver Halides

The photosensitive silver halide emulsion in the photothermographic material used in the invention may be used alone as one kind, or two or more kinds of them (for example, those of different average particle sizes, different halogen compositions, of different crystal habits and of different conditions for chemical sensitization) may be used together. Gradation can be controlled by using plural kinds of photosensitive silver halide of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

10) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably, from 0.05 $g/m^2$ to 0.4 $g/m^2$ and, further preferably, from 0.07 $g/m^2$ to 0.3 $g/m^2$. The photosensitive silver halide is used in the range from 0.01 mole to 0.5 mole, preferably, from 0.02 mole to 0.3 mole, and further preferably from 0.03 mole to 0.2 mole, per 1 mole of the organic silver salt.

11) Mixing Silver Halide and Organic Silver Salt

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of preparing an organic silver salt by mixing in a completed photosensitive silver halide preparation any time during the preparation of the organic silver salt. As long as the effect of the invention can be obtained any of the methods described above can be used without particular limitation. Further, when mixing, mixing 2 or more types of organic silver aqueous dispersions with two or more types of photosensitive silver salt aqueous dispersions is preferable from the perspective of adjusting the photographic properties.

12) Mixing Silver Halide into the Coating Solution

In the invention, the time of adding silver halide to the coating solution for the image forming layer is preferably in the range from 180 minutes before to just prior to the coating, more preferably, 60 minutes before to 10 seconds before coating. But there is no particular restriction on the mixing method and mixing conditions as long as the effect of the invention is sufficiently shown. As an embodiment of a mixing method, there is a method of mixing in a tank controlling the average residence time to the desired value. The average residence time herein is calculated from the addition flow volume and the amount of solution being transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunshakan, 1989).

(Binder)

Any kind of polymer may be used as the binder for the image forming layer in the photothermographic material of the invention as long as it is hydrophilic. Suitable binders are those that are transparent or translucent, and are generally colorless such as: natural resins or polymers and their copolymers; synthetic resins or polymers and their copolymers; or film forming media including, for example, gelatins, rubbers, poly(vinyl alcohols), hydroxyethyl celluloses, cellulose acetates, poly(vinyl pyrrolidones), caseins, starches, poly(acrylic acids) and poly(methylmethacrylic acids).

In the invention it is preferable that between 50 and 100% of the binder used in the organic silver containing layer is hydrophilic binder, with 70 to 100% being particularly preferable.

Substances which can be use as hydrophilic binders include, but are not limited to, gelatin and gelatin derivatives (alkali or acid treated gelatins, acetalized gelatins, oxidized gelatins, phthlated gelatins, or deionized gelatins), poly silicates, acrylamide/methacrylamide polymers, acryl/methacryl polymers, polyvinyl pyrrolidones, poly (vinyl acetates), poly (vinyl alcohols), poly (vinyl lactams), sulfoalkylacrylate and metacrylate polymers, hydrolised poly (vinyl acetates), polysaccharides (such as, for example dextran or starch ethers) or other synthetic or natural vehicles which are (according to the above definition) essentially hydrophilic (such as refer to Research Disclosure, Item 38957). However gelatin and derivatives thereof, and poly (vinyl alcohols) are more preferable as binders, and gelatin and derivatives thereof are most preferable.

In the invention, it is preferred that the image forming layer is formed by applying a coating solution containing 30% by mass or more of water in the solvent and by then drying, more preferably a coating solution containing 50% by mass or more of water.

The aqueous solvent in which the polymer is soluble or dispersible, as referred to herein, signifies water or water containing mixed therein 70% by mass or less of a water miscible organic solvent. As water miscible organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

Binders usable other than the hydrophilic binders preferably include polymers which are dispersible in an aqueous solvent. Preferred embodiments of such polymers includes hydrophobic polymers such as acrylic polymers, poly(esters), rubbers (e.g., SBR resin), poly(urethanes), poly(vinyl chlorides), poly(vinyl acetates), poly(vinylidene chlorides), poly(olefins), and the like.

As the polymers above, usable are straight chain polymers, branched polymers, or cross-linked polymers; also usable are the so-called homopolymers in which a single monomer is polymerized, or copolymers in which two or more types of monomers are polymerized. In the case of a copolymer, it may be a random copolymer or a block copolymer. The molecular weight of these polymers is, in number average molecular weight, in the range from 5,000 to 1,000,000, preferably from 10,000 to 200,000. Those having too small molecular weight exhibit insufficient mechanical strength on forming the image forming layer, and those having too large molecular weight are not preferred either, because the film forming properties are poor. Further, cross-linking polymer latexes are particularly preferred for use.

(Theckening Agents)

It is preferable in the image forming layer of the invention that gelatin or gelatin derivative thickening agents are included. Thickening agents which can be used in the invention include traditional thickening agents such as poly (sodium p-styrenesulfonate), as well linear polyvinyl polymers with sulfonate groups, sulfate ester groups, and carboxy groups and their salts in side chains thereof as disclosed in JP-A No. 63-11934.

(Other Additives)

In the image forming layer of the invention, cross-linking agents and curing agents for cross-linking the hydrophilic binder, and surfactants for improving the coating properties can be added.

(Preferable Solvent for Coating Liquid)

The solvent for the coating liquid of the image forming layer of the photothermographic material of the invention (for simplicity solvent refers to a solvent and a dispersion medium) preferably is an aqueous medium containing 30% or more by mass of water. For components other than water appropriate water miscible organic solvent can be used such as methyl alcohol, ethyl alcohol, isopropyl alcohol, methyl alcohol, ethyl alcohol, isopropyl alcohol, methyl cellosolve, ethyl cellosolve, dimethyl formamide, and ethyl acetate. The water content of the solvent of the coating liquid is preferably 50% by mass or above, and more preferably 70% or more. Preferable compositions of solvent include water/methyl alcohol at 90/10, water/methyl alcohol at 70/30, water/methyl alcohol/dimethylformamide at 80/15/5, water/methyl alcohol/ethylcellusolve at 85/10/5, water/methyl alcohol/isopropyl alcohol at 85/10/5 (all figures mass %).

(Antifoggant)

As antifoggants, stabilizers and stabilizer precursors usable in the invention, there can be mentioned those compounds disclosed in paragraph number 0070 of JP-A No. 10-62899 and in line 57 of page 20 to line 7 of page 21 of EP-A No. 0803764A1, and the compounds described in JP-A Nos. 9-281637 and 9-329864, in U.S. Pat. No. 6,083,681, and in European Patent No. 1048975.

1) Organic Polyhalogen Compound

Organic polyhalogen compounds which can preferably be used in the invention will be described in detail below. In the invention, as an antifoggant, the photothermographic material preferably contains the compound expressed by formula (H) below:

$$Q\text{-}(Y)n\text{—}C(X_1)(X_2)Z \qquad \text{Formula (H)}$$

In formula (H), Q represents an alkyl group, an aryl group or a heterocyclic group; Y represents a divalent linking group; n represents 0 or 1; and Z represents a halogen atom; and $X_1$ and $X_2$ represent a hydrogen atom or an electron-attracting group.

In formula (H), Q is preferably an alkyl group having 1 to 6 carbon atoms, an aryl group having 6 to 12 carbon atoms or a heterocyclic group such as pyridine group and quinoline group containing at least one nitrogen atom.

In formula (H), in the case where Q is an aryl group, Q preferably is a phenyl group substituted by an electron-attracting group whose Hammett substituent constant σp yields a positive value. For the details of Hammett substituent constant, reference can be made to Journal of Medicinal Chemistry, vol. 16, No. 11 (1973), pp. 1207 to 1216, and the like. As such electron-attracting groups, examples include, a halogen atom, an alkyl group substituted with an electron-attracting group, an aryl group substituted with an electron-attracting group, a heterocyclic group, an alkyl sulfonyl group or an aryl sulfonyl group, an acyl group, an alkoxycarbonyl group, a carbamoyl group and sulfamoyl group. Preferable electron-attracting groups include a halogen atom, group, a carbamoyl group and an aryl sulfonyl group. A particularly preferable group is a carbamoyl group.

At least one of $X_1$ and $X_2$ preferably is an electron-attracting group, more preferably, one selected from a halogen atom, an aliphatic sulfonyl group, an aryl sulfonyl group, a heterocyclic sulfonyl group, an aliphatic acyl group, an aryl acyl group, a heterocyclic acyl group, an aliphatic oxycarbonyl group, an aryl oxycarbonyl group, a heterocyclic oxycarbonyl group, carbamoyl group, and sulfamoyl group; A halogen atom and a carbamoyl group are particularly preferred. Among them, a bromine atom is particularly preferred.

Z is preferably a bromine atom or an iodine atom, more preferably a bromine atom. Y preferably represents —C(═O)—, —SO—, —$SO_2$—, —C(═O)N(R)— or —$SO_2$N(R)—; more preferably, —C(═O)—, —$SO_2$— or —C(═O)N(R)—; and particularly preferred is —$SO_2$— or —C(═O)N(R)—. Here, R is a hydrogen atom, an aryl group or an alkyl group, more preferably, a hydrogen atom or an alkyl group, particularly preferably is a hydrogen atom or alkyl group. n represents 0 or 1, and is preferably 1.

In formula (H), when Q is an alkyl group, preferably Y is —C(═O)N(R)—, and when Q is an aryl group or a heterocyclic group Y is preferably —$SO_2$—.

In formula (H), mutually linked forms of the groups remaining when hydrogen atoms have been removed from these compounds (generally called bis, tris, and tetrakis shapes) can be used.

In the formula (H), preferable forms are also ones including substituents such as dissociation groups (COOH group or salts thereof, $SO_3H$ group or salts thereof, $PO_3H$ group or salts thereof), quaternary nitrogen cation containing groups (for example ammonium groups and pyridinium groups), polyethylene oxy groups, hydroxyl groups.

Specific examples of the compounds of the invention shown by the formula (H) will be described below.

(H-1)

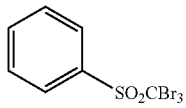

-continued (H-2)

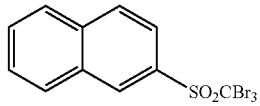

(H-3)

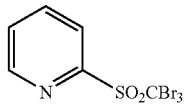

(H-4)

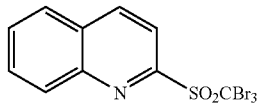

(H-5)

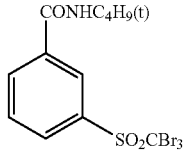

(H-6)

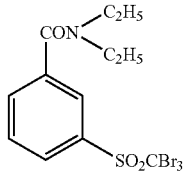

(H-7)

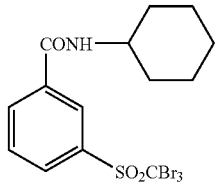

(H-8)

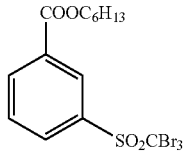

(H-9)

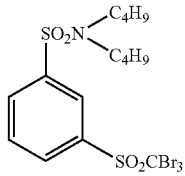

(H-10)

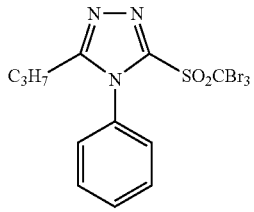

(H-11)

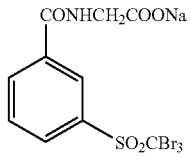

-continued (H-12)

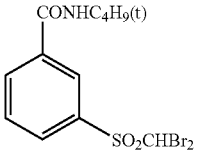

(H-13)

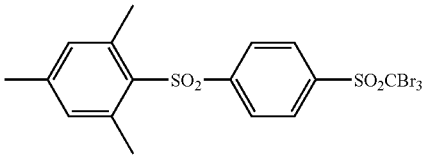

(H-14)

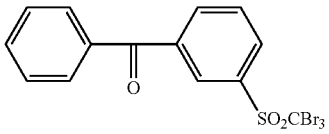

(H-15)

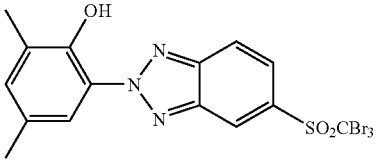

(H-16)

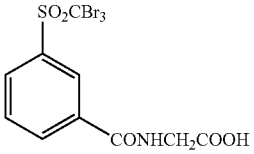

(H-17)

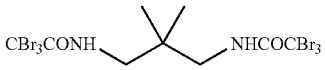

(H-18)

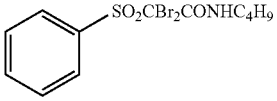

(H-19)

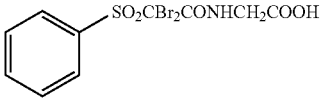

(H-20)

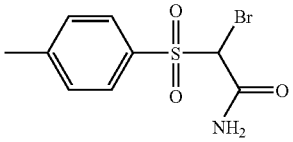

(H-21)

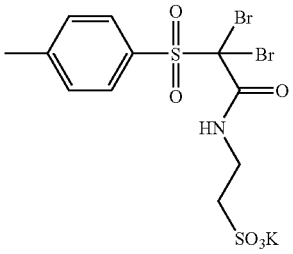

As preferred organic polyhalogen compounds of the invention other than those above, there can be mentioned compounds disclosed in U.S. Pat. Nos. 3,874,946, 4,756,999, 5,340,712, 5,369,000, 5,464,737, and 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. In particular, compounds disclosed in JP-A Nos. 7-2781, 2001-33911 and 2001-312027 are preferable.

The compounds expressed by formula (H) of the invention are preferably used in an amount from $10^{-4}$ mole to 1 mole, more preferably, $10^{-3}$ mole to 0.5 mole, and further preferably, $1\times10^{-2}$ mole to 0.2 mole, per 1 mole of non-photosensitive silver salt incorporated in the image forming layer.

In the invention, usable methods for incorporating the antifoggant into the photothermographic material are those described above as methods for incorporating the reducing agent, and similarly, for the organic polyhalogen compound, it is preferably added in the form of a solid fine particle dispersion.

2) Other Antifoggants

As other antifoggants, there can be mentioned mercury (II) salts described in paragraph number 0113 of JP-A No. 11-65021, benzoic acids described in paragraph number 0114 of the same publication, a salicylic acid derivative described in JP-A No. 2000-206642, a formaline scavenger compound expressed by formula (S) in JP-A No. 2000-221634, a triazine compound related to claim 9 of JP-A No. 11-352624, a compound expressed by formula (III), 4-hydroxy-6-methyl-1,3,3a,7-tetrazaindene and the like, as described in JP-A No. 6-11791.

The photothermographic material of the invention may further contain an azolium salt in order to prevent fogging. As azolium salts, there can be mentioned compounds expressed by formula (XI) as described in JP-A No. 59-193447, a compound described in JP-B No. 55-12581, and a compound expressed by formula (II) in JP-A No. 60-153039. The azolium salt may be added to any part of the photosensitive material, but as the addition layer, preferred is to select a layer on the side having thereon the image forming layer, and more preferred is to select the image forming layer. The azolium salt may be added at any time of the process of preparing the coating solution; in the case the azolium salt is added into the image forming layer, any time of the process may be selected, from the preparation of the organic silver salt to the preparation of the coating solution, but preferred is to add the salt after preparing the organic silver salt and just before the coating. As the method for adding the azolium salt, any method using a powder, a solution, a fine-particle dispersion, and the like, may be used.

Furthermore, it may be added as a solution having mixed therein other additives such as sensitizing agents, reducing agents, tone adjusting agents, and the like. In the invention, the azolium salt may be added at any amount, but preferably, it is added in a range of from $1\times10^{-6}$ mole to 2 mole, and more preferably, from $1\times10^{-3}$ mole to 0.5 mole per 1 mole of silver.

The compound used in the invention according to formula (I) and (II) will be explained.

Formula (I)

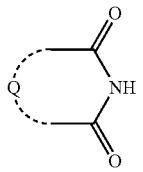

Formula (II)

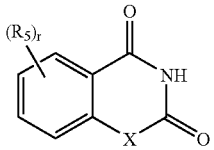

In formula (I) Q represents an atomic group necessary for forming a 5 or 6 member imide ring. In formula (II) $R_5$ independently represent one or more of a hydrogen atom, an alkyl group, a cycloalkyl group, an alkoxy group, an alkylthio group, an arylthio group, a hydroxy group, a halogen atom, or $N(R_8R_9)$ group, or the necessary atomic groups so that two $R_5$ groups can be linked together to form an aromatic, hetero aromatic, alicyclic ring or condensed hetero cyclic ring. Here $R_8$ and $R_9$ each independently represent a hydrogen atom, an alkyl group, an aryl group, a cycloalkyl group, an alkenyl group or a hetero ring or the necessary atomic groups so that $R_8$ and Rg can be linked together to form a substituted or unsubstituted 5 to 7 member hetero ring. X represents O, S, Se or $N(R_6)$, were $R_6$ is a hydrogen atom, alkyl group, aryl group, cycloalkyl group, alkenyl group or heterocyclic group and r is 0, 1 or 2.

1) Explanation of Formula (I)

In the structure of Q the nitrogen or carbon atom can be bonded to branches of hydrogen atoms, amino groups, alky groups with between 1 and 4 carbon atoms, halogen atoms, keto oxygen atom, or aryl groups. Specific examples of compounds including imide rings represented by the formula (I) include uracil, 5-bromouracil, 4-methyluracil, 5-methyluracil, 4-carboxyuracil, 4,5-dimethyluracil, 5-aminouracil, dihydrouracil, 1-ethyl-6-methyluracil, 5-carboxymethylaminouracil, barbituric acid, 5-phenylbarbituric acid, cyanuric acid, urazole, hydantoin, 5,5-dimethylhydantoin, glutarimide, glutaconimide, citrazinic acid, succinimide, 3,4-dimethylsuccinimide, maleimide, phthalimide, and naphthalimide. However the invention is not limited to these. In the invention, among the compounds containing an imide group represented by the formula (I) succinimide, phthalimide, naphthalimide, and 3,4-dimethylsuccinimide are preferable and succinimide is particularly preferable.

2) Explanation of Formula (II)

In formula (II) $R_5$ independently represent one or more of a hydrogen atom, an alkyl group, a cycloalkyl group, an alkoxy group, an alkylthio group, an arylthio group, a hydroxy group, a halogen atom, or $N(R_8R_9)$ group. Further, it can represent the necessary atomic groups so that two $R_5$ groups can be linked together to form an aromatic, hetero aromatic, alicyclic ring or condensed hetero cyclic ring. When $R_5$ represents an amino group $[N(R_8R_9)]$, $R_8$ and $R_9$ each independently represent a hydrogen atom, an alkyl group, an aryl group, a cycloalkyl group, an alkenyl group or a hetero ring. Further, then can represent the necessary atomic groups so that $R_8$ and Rg can be linked together to form a substituted or unsubstituted 5 to 7 member hetero ring. In formula (II) X represents O, S, Se or $N(R_6)$, were $R_6$ represents a hydrogen atom, alkyl group, aryl group, cycloalkyl group, alkenyl group or heterocyclic group. r is 0, 1 or 2.

Usable alkyl groups for $R_5$, $R_6$, $R_8$ and $R_9$ can be linear, branched or cyclic, and have between 1 and 20 carbon atoms, with 1 to 5 carbon atoms being preferable. Alkyl groups with 1 to 4 carbon atoms (such as, for example, methyl, ethyl, iso-propyl, n-butyl, t-butyl or sec-butyl) are especially preferable.

Usable aryl groups for $R_5$, $R_6$, $R_8$ and $R_9$ are aromatic rings (singular or multiple) with 6 to 14 carbon atoms therein. Preferable aryl groups are phenyl groups or substituted phenyl groups.

Usable cycloalkyl groups for $R_5$, $R_6$, $R_8$ and $R_9$ can have 5 to 14 carbon atoms in the central ring system. Preferable cycloalkyl groups are cyclopentyl or cyclohexyl.

Usable alkenyl groups and alkynyl groups can be branched or linear, and have between 2 and 20 carbon atoms. Preferable alkenyl groups are allyls.

Usable hetero ring groups for $R_5$, $R_6$, $R_8$ and $R_9$ can have 5 to 10 carbon, oxygen, sulfur, and/or nitrogen atoms in the central ring system and can have condensation rings.

These alkyl, aryl, cycloalkyl and hetero ring group are not limited, but can be further substituted with one or more group including a halo group, an alkoxycabonyl group, a hydroxyl group, an alkoxy group, a cyano group, an acyl group, an acyloxy group, a carbonyl oxyester group, a sulfonic acid ester group, an alkylthio group, a dialkylamino group, a carboxy group, a sulfo group, a phosphono group, or any other group well known to a person skilled in the art.

As alkoxy, alkylthio, and arylthio groups for $R_5$ can be used the alkyl and aryl groups which have been listed above. Preferable halogen groups are chloro and bromo. Typical compounds represented by the formula (II) are the compounds II-1 to II-10 listed below. The compound II-1 is particularly preferable.

(II-1)

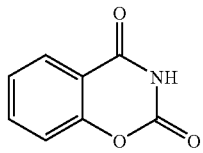

(II-2)

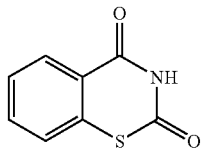

(II-3)

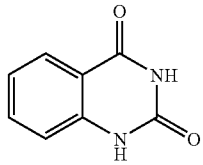

-continued (II-4)

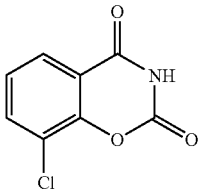

(II-5)

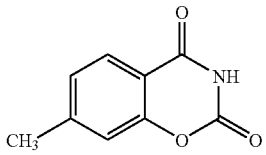

(II-6)

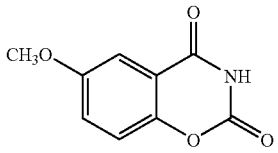

(II-7)

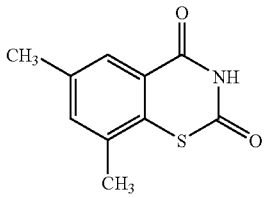

(II-8)

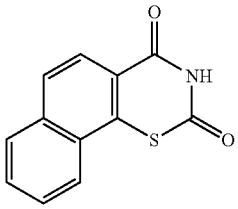

(II-9)

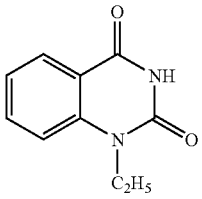

(II-10)

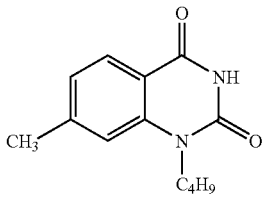

Other usable substituted benzoxazine diones are disclosed in the specification of U.S. Pat. No. 3,951,660 (Hagermann et al). These compounds of formula (I) and (II) are preferably used as toners. As compounds of formula (I) and (II) which can be used together as toners there are combinations of phthalazinone and phthalazinone derivatives or the metal salts of derivatives thereof such as 4-(1-naphthyl)phthalazine-dione, 6-chlorophthalazinone, 5,7-dimethoxyphthalazinone and 2,3-dihydro-1,4-phthlazine; and combinations of phthalazine and phthalazine derivatives (for example 5-isopropylphthlazine) with phthalic acid derivatives (e.g., phthalic acid, 4-methylphthalic acid, 4-nitrophthalic acid, and tetrachlorophthalic acid).

The amount used of these compounds according to the formulas (I) and (II) is preferably from 0.01 g/m$^2$ to 2.0 g/m$^2$, more preferable is 0.02 g/m$^2$ to 1.0 g/m$^2$, and most preferable is 0.05 g/m$^2$ to 0.8 g/m$^2$.

As long as it is on the image forming side it does not matter in which of the layers the compounds according to the formulas (I) and (II) are added to. It is possible to add the compounds to the image forming layer or the non-photosensitive layer. It is preferable that these are added to the image forming layer.

It is preferable that the compounds of formulas (I) and (II) are added as aqueous solutions, but for compounds which are not soluble enough in water, they can be dissolved in an organic solvent or water/organic solvent mixture and added. As organic solvents, ones which are compatible with water are preferable, and methyl alcohol, ethyl alcohol, DMF, THF, acetone, ethyl acetate and the like can be used. Further, the compounds of formulas (I) and (II) can be dispersed, by methods such as solid dispersion and emulsion dispersion, and added.

(Plasticizer, Lubricant)

In the invention, a known plasticizer or lubricant may be used in order to improve the physical properties of the film. It is particularly preferable to employ a lubricant such as liquid paraffin, a long-chain fatty acid, a fatty acid amide or a fatty acid ester in order to improve the handling properties during manufacture and scratch resistance during thermal development. Particularly preferred are liquid paraffins from which low-boiling components have been removed or fatty acid esters of branched structures with molecular weights of 1,000 or higher.

Plasticizer and lubricant compounds preferably employable in the invention are described in JP-A Nos. 11-65021, paragraph 0117, and 2000-5137, and Japanese Patent Applications Nos. 2003-8015, 2003-8071 and 2003-132815.

(Dye, Pigment)

In the photosensitive layer of the invention, for the purposes of color tone improvement, prevention of interference fringes during laser exposure and prevention of irradiation, there may be employed various dyes and pigments (for example C. I. Pigment Blue 60, C. I. Pigment Blue 64, or C. I. Pigment Blue 15:6). These are described in detail for example in WO98/36322, and JP-A Nos. 10-268465 and 11-338098.

(Nucleation Agent)

In the photothermographic material of the present invention, it is preferable to add a nucleation agent in the image forming layer. The nucleation agent, methods of addition thereof and amounts of addition thereof are described for example in JP-A No. 11-65021, paragraph 0118, JP-A No. 11-223898, paragraphs 0136-0193, JP-A No. 2000-284399, formulas (H), (1) to (3), (A) and (B), and Japanese Patent Application No. 11-91652, general formulas (III) to (V) (specific compounds in formulas 21–24), while a nucleation promoting agent is described in JP-A No. 11-65021, paragraph 0102 and JP-A No. 11-223898, paragraphs 0194-0195.

In order to employ formic acid or a formate salt as a strong fogging substance, it is preferably added on the side having the image forming layer and containing photosensitive silver halide, and included in an amount of 5 mmole or less per 1 mole of silver, more preferably 1 mmole or less.

In the photothermographic material of the invention, when a nucleation agent is used, it is preferable that is used together with acids which can be formed by hydration of diphosphorus pentoxide, or salts of these acids. As acids or salts which can be formed by hydration of diphosphorus pentoxide there are the examples of metaphosphoric acid (salts), pyrophosphoric acid (salts), orthophosphoric acid (salts), triphosphoric acid (salts), tetraphosphoric acid (salts), and hexametaphosphoric acid (salts). Particularly preferably used acids formed by hydration of diphosphorus pentoxide or salts thereof are orthophosphoric acid (salts) and hexametaphosphoric acid (salts). Specific examples of the salts are sodium orthophosphate, sodium dihydrogenorthophosphate, sodium hexametaphosphate, ammonium hexametaphosphate and the like.

Acids formed by hydration of diphosphorus pentoxide or salts thereof may be used in a desired amount (coating amount per $m^2$ of the photosensitive material) depending on the desired performance including sensitivity and fogging. However, it can be used in an amount of preferably 0.1 to 500 $mg/m^2$, more preferably 0.5 to 100 $mg/m^2$.

It is preferable to use the reducing agent, hydrogen bonding compound, development promoting agent and polyhalogen compounds of the invention in the form of solid dispersions. Preferable methods of manufacturing these solid dispersions are disclosed in JP-A No. 2002-55405.

(Layer Constitution and Constituting Components)

The photothermographic material according to the invention has a non-photosensitive layer in addition to the image forming layer. Non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided to the side opposite to the image forming layer.

The surface protective layer may be a single layer, or plural layers. In the present invention, a layer, in which hydrophilic binder is contained at 70% by mass or more of the total binder, is preferably provided as the outermost layer on the side of the image forming layer.

Furthermore, a layer that functions as an optical filter may be provided as layers (a) or (b) above. An antihalation layer may be provided as layers (c) or (d) to the photosensitive material.

1) Outermost Layer (Hydrophilic Polymer)

In the binder of the non-photosensitive layer of the invention, hydrophilic binder is contained at 70% by mass, preferably 80% by mass or more, and more preferably 90% or more.

The hydrophilic polymer can be an animal protein derivative hydrophilic polymer, or a hydrophilic polymer which is not an animal protein derivative, but, from the perspective of setting properties and effectively trapping of generated organic acids, it is preferable that the hydrophilic polymer is an animal protein derivative.

<Animal Protein Derivative Hydrophilic Polymers>

In the invention, for the animal protein derivative hydrophilic polymers, natural, such as animal glues, caseins, gelatins, albumin, or chemically modified polymers can be used. Gelatin is preferable, and, depending on the synthesis method, acid treated gelatins or alkali treated gelatins (such as lime treated) are available. Any of these can be preferably used. It is preferable that a gelatin with a molecular weight of 10,000 to 1,000,000 is used. Further, a modified gelatin, formed by a modification treatment using the amino or carboxyl group of the gelatin, can be used (for example phthalated gelatin).

<Hydrophilic Polymers Not Derived from Animal Proteins>

Hydrophilic polymers not derived from animal proteins are natural polymers which are not animal proteins like gelatins (polysaccharide based, microorganism or animal based), semi-synthetic polymers (cellulose based, starch based, alginic acid based) and synthetic polymers (vinyl based, non-vinyl based). Included are the synthetic polymers such as the polyvinyl alcohol described below, natural and semi-synthetic polymers using raw materials such as plant derived cellulose. Preferable are polyvinyl alcohols, and acrylic acid-vinyl alcohol co-polymers. Since hydrophilic polymers not derived from animal proteins don't have setting properties, so when hydrophilic polymers not derived from animal proteins are used in the layer adjacent to the outermost layer, as will be explained later, it is preferable to add a gelling agent.

For hydrophilic polymers not derived from animal proteins of the invention, polyvinyl alcohols are preferable. Preferable polyvinyl alcohols (PVAs) for use in the invention are copolymers of various saponification degree, polymerization degree, saturation degree, and modified moiety and from various monomers.

Modified polyvinyl alcohols can be chosen from cationic modified, anionic modified, modified with an —SH compound, modified with a alkylthio compound, and modified with a silanol. Other than these, the modified polyvinyl alcohols described in "Poval" by Koichi Nagano et al can be used.

By the addition of trace quantities of solvents or inorganic salts the viscosity of the polyvinal alcohols can be adjusted and stabilized. For details of what can be used refer to page 144 to page 154 of the polymer journal referenced above "Poval" by Koichi Nakano et al. A typical example is being able to improve the coated surface properties by the inclusion of boric acid. The amount of boric acid added is preferably 0.01% to 40% by mass relative to the polyvinyl alcohol.

Further, it is described in the above reference "Poval" how, by heat treatment, the degree of crystallization and water resistance can be increased of the polyvinyl alcohol. In view of this, in order to increase the water resistance, heating during drying of the coating, or additional heat treatment after drying, is preferably carried out.

Still further, in order to increase the water resistance, it is preferable to add a water proofing agent, such as the ones described in the above publication on pages 256 to 261. For example, aldehydes, methylol compounds (such as N-methylolurea, N-methylolmelamine), activated vinyl compounds (such as divinyl sulfone and derivatives thereof), bis (beta-hydroxyethyl sulfone), epoxy compounds (such as epichlorohydrin and derivatives thereof), polycarboxylic acids (dicarboxylic acid, polyacrylic acids such as a polycarboxylic acid, and methylvinylether/maleic acid copolymers, isobutylene-maleic acid anhydride copolymers), diisocyanates, inorganic cross-linking agents (Cu, B, Al, Ti, Zr, Sn, V, Cr compounds).

Preferable water proofing agents for use in the invention are inorganic cross-linking agents, and among these boric acid and its derivatives are preferable, particularly preferable is boric acid. For hydrophilic polymers not derived from animal proteins, apart from the above polyvinyl alcohols, the following can be also used.

Specific examples which can be given of plant based polysaccharides are Gum Arabic, kappa-carrageenan, iota-carrageenan, lambda-carrageenan, guar gum (such as trade name: Supercol manufactured by Squalon), locust bean gum, pectin, gum tragacanth, corn starch (such as trade name: Purity-21; manufactured by National Starch and Chemical Co. ), phosphated starch (such as trade name: National 78–1898; manufactured by National Starch & Chemical Co.).

Also, as microorganism based polysaccharides there are xantha gum (such as trade name: Keltrol T; manufactured by Kelco), dextrin (such as trade name: Nadex360; manufactured by National Starch and Chemical Co.). For animal based polysaccharides there is sodium chondroitin sulphate (such as trade name: Cromoist CS; manufactured by Cronda).

Or, as cellulose based polymers there are ethylcelluloses (such as trade name: Cellofas WLD; manufactured by ICI), carboxymethyl celluloses (such as trade name: CMC; manufactured by Daicel Polymer Ltd.), hydroxyethyl celluloses (such as trade name: HEC; manufactured by Daicel Polymer Ltd.), hydroxypropyl celluloses (such as trade name: Klucel; manufactured by Aqualon), methyl celluloses (such as trade name: Viscontran; manufactured by Henkel), nitrocelluloses (such as trade name: Isopropyl Wet; manufactured by Hercules), and catonized celluloses (such as trade name: Crodacel QM; manufactured by Croda). As alginic acid based polymers there is sodium alginates (such as trade name: Keltone; manufactured by Kelco), and propyleneglycol alginates and the like. As other types of polymer there is catonized guar gum (such as trade name: Hi-care 1000; manufactured by Alcolac), and sodium hyaluronate (such as trade name: Hyalure; manufactured by Lifecare Biomedial).

In addition, other examples which can be given are agar, furcellaran, guar gum, karaya gum, larch gum, guar seed gum, psyllium seed gum, quince seed gum, tamarind gum, gellan gum, and tara gum. Among these, those which have high water solubility are preferred, and preferably used are those which undergo sol-gel transformation in less than 24 hours when the temperature is varied within the range of 5 to 95° C.

Examples which can be given of synthetic polymers are: acrylic based polymers, such as sodium polyacrylate, polyacrylate copolymers, polyacrylamides, polyacrylamide copolymers and the like; vinyl based polymers, such as polyvinyl pyrrolidones, polyvinyl pyrrolidone copolymers, and the like; and also, polyethyleneglycols, polypropyleneglycols, polyvinylethers, polyethyleneimines, polystyrene sulfonates and copolymers thereof, polyvinyl sulfanates and copolymers thereof, polyacrylates and copolymers thereof, acrylates and copolymers thereof, maleic acid copolymers, maleic acid monoesters copolymers, acryloylmethylpropane sulphonates and copolymers thereof, and the like.

Further more, polymers with high water absorbancy, as disclosed in the specification of U.S. Pat. No. 4,940,681, JP-A No. 62-245260, can also be used. That is homopolymers of vinyl monomers containing —COOM or —$SO_3M$ (where M is a hydrogen atom or alkali metal), or copolymers of two or more of these vinyl monomers or of these monomers with other vinyl monomers (for example sodium methacrylate, ammonium methacrylate, trade name: Sumicagel L-5H; manufactured by Sumitomo Chemical Co. Ltd).

Among these, as hydrophilic polymers not derived from animal protein, the product of trade name Sumicagel L-5H manufactured by Sumitomo Chemical Co. Ltd is preferably used.

<Gelling Agent and Gelation Accelerator>

The gelling agent in the present invention is a substance which causes gelling of the solution by adding it to an aqueous solution of water-soluble polymer not derived from animal protein and cooling, or a compound which undergoes gelling in combined use with a gelation accelerator. The fluidity falls remarkably by undergoing gelling.

The following water-soluble polysaccharides can be described as specific examples of the gelling agent. Namely, these are at least one kind selected from agar, kappa-carrageenan, iota-carrageenan, alginic acid, alginate salts, agarose, furcellaran, gellan gum, glucono delta-lactone, azotobacter vinelandii gum, xanthan gum, pectin, guar gum, locust been gum, tara gum, cassia gum, glucomannan, tragacanth gum, karaya gum, pullulan, gum arabic, arabinogalactan, dextran, sodium carboxymethyl cellulose, methyl cellulose, psyllium seed gum, starch, chitin, chitosan and curdlan.

As examples of compounds which gel by cooling after being dissolved by heating, agar, carrageenan, gellan gum and the like can be given.

Among these gelling agents, kappa-carrageenan (e.g., trade name:K-9F, produced by DAITO Co.; trade names K-15, 21, 22, 23, 24, and I-3, all produced by NITTA GELATIN Co.), iota-carrageenan and agar are more preferable, and kappa-carrageenan is particularly preferable. The gelling agent is preferably used in a range from 0.01% by mass to 10.0% by mass, preferably 0.02% by mass to 5.0% by mass, and more preferably 0.05% by mass to 2.0% by mass, with respect to the binder polymer.

The gelling agent is preferably used with a gelation accelerator. The gelation accelerator in the present invention is a compound which accelerates gelation by contact with a gelling agent, whereby the gelling function can be realized by specific combinations with gelling agents. In the present invention, the combination of the gelling agent and the gelation accelerator shown below can be used.

(i) A combination of an alkali metal ion such as potassium ion and the like or an alkali earth metal ion such as a calcium ion, magnesium ion, and the like as the gelation accelerator, with carrageenan, alginate salts, gellum gum, azotobactor vinelanddi gum, pectin, sodium carboxymethyl cellulose, and the like as the gelling agent.

(ii) A combination of boric acid and other boric acid compound as the gelation accelerator, with guar gum, locust been gum, tara gum, cassia gum, and the like as the gelling agent.

(iii) A combination of acid or alkali compounds as the gelation accelerator with alginate salts, glucomannan, pectin, chitin, chitosan, curdlan and the like as the gelling agent.

(iv) A water-soluble polysaccharide which can form a gel by reaction with the gelling agent is used as the gelation accelerator. As specific examples, a combination of using xanthan gum as the gelling agent with cassia gum as the gelling accelerator, and a combination of carrageenan as the gelling agent with locust been gum as the gelation accelerator, and the like can be given.

As the specific examples of combinations of these gelling agents and gelation accelerators, the following combinations a) to g) can be given.

a) combination of κ-darrageenan and potassium
b) combination of ι-carrageenan and calcium
c) combination of low methoxyl pectin and calcium
d) combination of sodium arginate and calcium
e) combination of gellan gum and calcium
f) combination of gellan gum and an acid
g) combination of locust been gum and xanthan gum These combinations can be used as plural combinations simultaneously. Although these galation accelerators can be added to the same layer in which the gelling agent is added, they preferably act by being added to different layers. It is more preferably to add these galation accelerators to a layer which is not directly adjacent to the layer to which the gelling agent is added. Namely, it is preferable to have a layer not containing any of the gelling agent or the galation accelerator located between the layer containing the gelling agent and the layer containing the galation accelerator.

The galation accelerator is used in a range from 0.1% by mass to 200% by mass, and preferably 1.0% by mass to 100% by mass, with respect to the gelling agent.

<Combined Use of Hydrophobic Polymers>

In the binder of the non-photosensitive layer, hydrophobic polymers can be used in combination, as long as the amount is in a range which does not exceed 30% of the above hydrophilic polymers. For hydrophobic polymers for combined use, polymers which can be dispersed in an aqueous solvent are preferable.

Polymers which can be appropriately dispersed in an aqueous solvent are synthetic resins and polymers or copolymers, and other film forming media. Examples which can be given include celluloses, cellulose acetate butylates, poly (methyl methacrylates), copolymers of styrene-maleic acid anhydride, copolymers of styrene-acrylonitrile, copolymers of styrene-butadine, poly (vinyl acetals) (for example poly (vinyl formal) or poly (vinyl butyral)), poly (esters), poly (urethanes), phenoxy resins, poly (vinylidene chloride), poly (epoxides), poly (carbonates), poly (vinyl acetates), poly (olefins), cellulose esters, and poly (amides).

(Binder Coating Amount)

In the non-photosensitive layer the total coating amount of binder (including hydrophilic binder and latex polymer) is preferably in the range 0.3 g/m$^2$ to 5.0 g/m$^2$, and more preferably from 0.3 g/m$^2$ to 2.0 g/m$^2$.

(Additives)

In the non-photosensitive layer, as well as binder various additives can be added. For example surfactants, pH adjusting agents, preservatives, fungicides, and the like can be used as additives.

Further, when the non-photosentitive layer is a protective layer, it is preferable that lubricants such as liquid paraffin, fatty acid esters and the like are added. The amount of lubricants added are in the range of 1 mg/m$^2$ to 200 mg/m$^2$, and preferably from 10 mg/m$^2$ to 150 mg/m$^2$, and more preferably from 20 mg/m$^2$ to 100 mg/m$^2$.

2) Antihalation Layer

The photothermographic material of the present invention may comprise an antihalation layer provided to the side farther from the light source with respect to the image forming layer.

Descriptions on antihalation layers can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in visible region.

In the case of preventing halation from occurring by using a dye having absorption in visible region, it is preferred that the color of the dye would not substantially remain after image formation, and is preferred to employ a means for bleaching color by the heat of thermal development. In particular, it is preferred to add a thermal bleaching dye and a base precursor to the non-photosensitive layer to impart the action of an antihalation layer. These techniques are described in JP-A No. 11-231457 and the like.

The addition amount of the thermal bleaching dye is determined depending on the application for the dye. In general, it is used at an amount such that the optical density (absorbance) exceeds 0.1 when measured at the desired wavelength. The optical density is preferably in the range from 0.15 to 2. The addition amount of dyes to obtain optical density in the above range is generally from 0.001 g/m$^2$ to 1 g/m$^2$.

By decoloring dye in such a manner, the optical density after thermal development can be lowered to 0.1 or lower. Two or more kinds of thermal bleaching dyes may be used in combination in a photothermographic material. Similarly, two or more kinds of base precursors may be used in combination.

In the case of thermal decolorization by the combined use of a decoloring dye and a base precursor, it is advantageous from the viewpoint of thermal decoloring efficiency to further use a substance capable of lowering the melting point by at least 3° C. when mixed with the base precursor (e.g., diphenylsulfone, 4-chlorophenyl(phenyl)sulfone), or 2-napthyl benzoate as disclosed in JP-A No. 11-352626.

3) Back Layer

Back layers which can be used in the invention are described in paragraph Nos. 0128 to 0130 of JP-A No. 11-65021.

In the invention, coloring agents having a maximum absorption in the wavelength range from 300 nm to 450 nm may be added in order to improve color tone of developed silver images and the deterioration of images during aging. Such coloring agents are described in, for example, JP-A Nos. 62-210458, 63-104046, 63-103235, 63-208846, 63-306436, 63-314535, 01-61745, 2001-100363, and the like.

Such coloring matters are generally added in the range from 0.1 mg/m$^2$ to 1 g/m$^2$, preferably to the back layer which is provided on the opposite surface side of the support from the image forming layer.

Further, in order to control the basic color tone, it is preferred to use a dye having an absorption peak in the wavelength range from 580 nm to 680 nm. As a dye satisfying this purpose which have low absorption intensity on the short wavelength side, preferred are oil-soluble azomethine dyes described in JP-A Nos. 4-359967 and 4-359968, or water-soluble phthalocyanine dyes described in JP-A No. 2003-295388. The dyes for this purpose may be added to any of the layers, but more preferred is to add them to a non-photosensitive layer on the image forming surface side, or on the back surface side.

The photothermographic material of the invention has, an image forming layer containing at least one silver halide emulsion formed on one side of the support, on the other side there is a back layer. That is it is preferable to have a one-sided photosensitive material.

4) Matting Agent

In the invention, it is preferable to add a matting agent for improving the transporting properties. Matting agents are described in JP-A No. 11-65021, paragraphs 0126–0127. An amount of the matting agent, in a coating amount per 1 $m^2$ of the photosensitive material, is preferably 1 to 400 $mg/m^2$, more preferably 5 to 300 $mg/m^2$.

In the invention, the matting agent may have a defined shape or an amorphous shape, however it is preferably of a defined shape, and a spherical shape is preferably employed. The matting agent to be used on the image forming layer surface preferably has a sphere-equivalent diameter, in a volume-weighted average, of 0.3 to 10 μm, further preferably 0.5 to 7 μm. Also a fluctuation factor of the size distribution of the matting agent is preferably 5 to 80%, more preferably 20 to 80%. The fluctuation factor is represented by (standard deviation of particle size)/(average of particle size)×100. It is also possible to use, in combination, two or more matting agents having different average particle sizes on the image forming layer side. In such a case, the matting agent with the largest average particle size and the matting agent with the smallest average particle size preferably have a particle size difference of 2 to 8 μm, and more preferably 2 to 6 μm.

The matting agent to be used on the back side preferably has a sphere-equivalent diameter, in a volume-weighted average, of 1 to 15 μm, further preferably 3 to 10 μm. Also a fluctuation factor of the size distribution of the matting agent is preferably 3 to 50%, more preferably 5 to 30%. For the matting agent of the back side, it is also possible to use, in combination, two or more matting agents having different average particle sizes. In such case, the matting agent with the largest average particle size and the matting agent with the smallest average particle size preferably have a particle size difference of 2 to 14 μm, more preferably 2 to 9 μm.

In the invention, the matting agent is preferably included in an outermost surface layer of the photosensitive material, a layer functioning as an outermost surface layer, or a layer close to the external surface, or it is preferably included in a layer functioning as a protective layer.

A matting degree of an emulsion surface may be arbitrarily selected as long as so-called starburst defects do not occur, but is preferably within a range of Beck's smoothness of 30 to 2000 seconds, particularly preferably 40 to 1500 seconds. The Beck's smoothness can be easily determined according to the known smoothness testing method according to JIS P8119 "Smoothness testing for paper and paperboard using a Beck tester" and TAPPI standard method T479.

In the invention, a matting degree of the back layer is preferably within a range of Beck's smoothness of 1200 to 10 seconds, more preferably 800 to 20 seconds and even more preferably 500 to 40 seconds.

5) Polymer Latex

Especially when the photothermographic material of the invention is used for printing applications where dimensional changes are a problem, it is preferable that a polymer latex is used in the surface protective layer and the back layer of the present invention. As such polymer latex, descriptions can be found in "Gosei Jushi Emulsion (Synthetic resin emulsions)" (Taira Okuda and Hiroshi Inagaki, Eds., published by Kobunshi Kankokai (1978)), "Gosei Latex no Oyo (Applications of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by mass)/ethyl acrylate (50% by mass)/methacrylic acid (16.5% by mass) copolymer, a latex of methyl methacrylate (47.5% by mass)/butadiene (47.5% by mass)/itaconic acid (5% by mass) copolymer, a latex of ethyl acrylate/methacrylic acid copolymer, a latex of methyl methacrylate (58.9% by mass)/2-ethylhexyl methacrylate (25.4% by mass)/styrene (8.6% by mass)/2-hydroethyl methacrylate (5.1% by mass)/acrylic acid (2.0% by mass) copolymer, a latex of methyl methacrylate (64.0% by mass)/styrene (9.0% by mass)/butyl acrylate (20.0% by mass)/2-hydroxyethyl methacrylate (5.0% by mass)/acrylic acid (2.0% by mass) copolymer, and the like.

Furthermore, as the binder for the surface protective layer, there can be applied the polymer latex combinations disclosed in JP-A No. 11-6872, the technology described in paragraph Nos. 0021 to 0025 of the specification of JP-A No. 2000-267226, the technology described in paragraph Nos. 0027 to 0028 of the specification of JP-A No. 11-6872 and the technology described in paragraph Nos. 0023 to 0041 of the specification of JP-A No. 2000-19678. The polymer latex in the surface protective layer preferably is contained in an amount of 10% by mass to 90% by mass, particularly preferably, of 20% by mass to 80% by mass of the total weight of binder.

6) Surface pH

The surface pH of the photothermographic material according to the invention preferably has a pH of 7.0 or lower, and more preferably, 6.6 or lower, before the thermal developing process. Although there is no particular restriction concerning the lower limit, the lower limit of pH value is about 3, and the most preferred surface pH range is from 4 to 6.2. From the viewpoint of reducing the surface pH, it is preferred to use an organic acid such as a phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener may be used in each of image forming layer, protective layer, back layer, and the like. As examples of hardeners, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone compounds of JP-A No. 62-89048 and the like.

The hardener is added as a solution, and the solution is added to the coating solution for forming the protective layer 180 minutes before coating to just before coating, and preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in a tank, in which the average retained time calculated from the flow rate of addition and the feed rate to the coater is controlled to yield a desired time, or a method using a static mixer as described in Chapter 8 of N. Harnby, M. F. Edwards, A. W. Nienow (translated by Koji Takahashi) "Liquid Mixing Technology" (Nikkan Kogyo Shinbunsha, 1989), and the like.

8) Surfactant

As for the surfactant, the solvent, the support, antistatic agent or electrically conductive layer, and the method for obtaining color images applicable in the invention, there can be mentioned those disclosed in paragraph Nos. 0132, 0133, 0134, 0135, and 0136, respectively, of JP-A No. 11-65021. Slip agents are described in paragraphs 0061 to 0064 of JP-A No. 11-84573 and paragraphs 0049 to 0062 of JP-A No. 2001-83679.

In the invention, it is preferred to use a fluorosurfactant. Specific examples of fluorosurfactants can be found in the compounds described in JP-A Nos. 10-197985, 2000-19680, and 2000-214554. Also the polymer fluorosurfactants described in JP-A 9-281636 can be used preferably. For the photothermographic material in the invention, the fluorocarbon surfactants described in JP-A Nos. 2002-82411, 2003-57780, and 2003-014976 can be preferably used.

Especially, when manufacturing a coating liquid the usage of the fluorosurfactants described in JP-A Nos. 2003-57780 and 2001-264110 in an aqueous coating solution is preferred, from the perspective of capacity to control static, stability of the coating surface state and slippiness. The fluorosurfactant described in JP-A No. 2001-264110 is most preferred because of its high capacity to control static and the small amount that needs to be used.

According to the invention, fluorosurfactant can be used on either the image forming layer surface side or back layer surface side, but use on both sides is preferred. Further, combined use with an electrically conductive layer, including metal oxides described below, is particularly preferred. In this case sufficient functionality can be obtained with the amount of the fluorosurfactant on the side of the electrically conductive layer reduced or removed.

The addition amount of the fluorosurfactant is preferably in a range of from 0.1 mg/m$^2$ to 100 mg/m$^2$ on each of the image forming layer surface side and back layer surface side, more preferably from 0.3 mg/m$^2$ to 30 mg/m$^2$, and further preferably from 1 mg/m$^2$ to 10 mg/m$^2$. Especially, the fluorosurfactant described in JP-A No.2001-264110 is effective, and used preferably in a range of from 0.01 mg/m$^2$ to 10 mg/m$^2$, and more preferably from 0.1 mg/m$^2$ to 5 mg/m$^2$.

9) Antistatic Agent

The photothermographic material of the invention preferably contains an electrically conductive layer including metal oxides or electrically conductive polymers. The antistatic layer may also serve as an undercoat layer, or a back surface protective layer, and the like, but can be specially provided. As an electrically conductive material of the antistatic layer, metal oxides having enhanced electric conductivity by the method of introducing oxygen defects or different types of metallic atoms into the metal oxides are preferably for use. Examples of metal oxides preferably selected are ZnO, $TiO_2$ and $SnO_2$. Examples of combinations of different types of atoms, preferred is ZnO with Al, In additions; $SnO_2$ with Sb, Nb, P, halogen atoms additions, and the like; $TiO_2$ with Nb, Ta, and the like additions.

Particularly preferred for use is $SnO_2$ with Sb additions. The addition amount of different types of atoms is preferably in a range of from 0.01 mole % to 30 mole %, and more preferably, in a range of from 0.1 mole % to 10 mole %. The shape of the metal oxides can include, for example, spherical, needle-like, or plate-like shape. The needle-like particles, with the ratio of (the major axis)/(the minor axis) which is more than 2.0, and more preferably, 3.0 to 50, is preferred, viewed from the standpoint of the electric conductivity effect. The metal oxides is used preferably in a range from 1 mg/m$^2$ to 1000 mg/m$^2$, more preferably from 10 mg/m$^2$ to 500 mg/m$^2$, and even more preferably from 20 mg/m$^2$ to 200 mg/m$^2$.

The antistatic layer can be placed on either of the image forming layer surface side or the back layer surface side, however it is preferably placed between the support and the back layer. Examples of the antistatic layer in the invention include described in paragraph number 0135 of JP-A No. 11-65021, JP-A Nos. 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898.

10) Support

As the transparent support, favorably used is a polyester, particularly, polyethylene terephthalate, which is subjected to heat treatment in the temperature range of from 130° C. to 185° C. in order to relax the internal strain caused by biaxial stretching which remains inside the film, and to remove strain ascribed to heat shrinkage generated during the thermal developing process. In the case of a photothermographic material for medical use, the transparent support may be colored with a blue dye (for instance, dye-1 described in the examples of JP-A No. 8-240877), or may be uncolored. As to the support, it is preferred to apply undercoating technology, such as the water-soluble polyesters described in JP-A No. 11-84574, a styrene-butadiene copolymer described in JP-A No. 10-186565, a vinylidene chloride copolymer described in JP-A No. 2000-39684 and paragraphs 0063 to 0080 of JP-A 11-106881 and the like. The moisture content of the support is preferably 0.5% by mass or less when coating for the image forming layer and back layer is conducted on the support.

11) Other Additives

Furthermore, antioxidants, stabilizing agents, plasticizers, UV absorbents, or a film forming promoting agents may be added to the photothermographic material. Each of the additives is added to either of an image forming layer or a non-photosensitive layer. Reference can be made to WO No. 98/36322, EP-A No. 803764A1, JP-A Nos. 10-186567 and 10-18568, and the like.

12) Coating Method

The photothermographic material of the invention may be coated by any method. More specifically, various types of coating operations can be used including extrusion coating, slide coating, curtain coating, immersion coating, knife coating, flow coating, and extrusion coating using the type of hopper described in U.S. Pat. No. 2,681,294. Preferably used is extrusion coating or slide coating as described in pages 399 to 536 of Stephen F. Kistler and Petert M. Schweizer, "LIQUID FILM COATING" (Chapman & Hall, 1997), and most preferably used is slide coating. Example of the shape of the slide coater for use in slide coating is shown in FIG. 11*b*.1, page 427, of the same literature. If desired, two or more layers can be coated simultaneously by the method described in pages 399 to 536 of the same literature, or by the method described in U.S. Pat. No. 2,761,791 and British Patent No. 837095. Particularly preferred in the invention are the methods described in JP-A Nos. 2001-194748, 2002-153808, 2002-153803, and 2002-182333.

The coating solution for the layer containing organic silver salt in the invention is preferably a so-called thixotropic fluid. For the details of this technology, reference can be made to JP-A No. 11-52509. Viscosity of the coating solution for the image forming layer in the invention at a shear rate of $0.1s^{-1}$ is preferably in the range from 400 mPa·s to 100,000 mPa·s, and more preferably, from 500 mPa·s to 20,000 mPa·s. At a shear rate of $1000s^{-1}$, the viscosity is preferably in the range from 1 mPa·s to 200 mPa·s, and more preferably, from 5 mPa·s to 80 mPa·s.

In the case of mixing two types of liquids on preparing the coating solution of the invention, known in-line mixers and in-plant mixers can be used favorably. Preferred in-line mixers of the invention are described in JP-A No. 2002-85948, and in-plant mixers are described in JP-A No. 2002-90940.

The coating solution of the invention is preferably subjected to defoaming treatment to maintain the coating surface in good condition. Preferred defoaming treatment methods for the invention are described in JP-A No. 2002-66431.

In the case of applying the coating solution of the invention to the support, it is preferred to perform removal of electricity in order to prevent the adhesion of dust, particulates, and the like due to charge build up. Preferred example of methods of electricity removal for use in the invention are described in JP-A No. 2002-143747.

Since a non-setting coating solution is used for the image forming layer in the invention, it is important to precisely control the drying air and the drying temperature. Preferred drying methods for use in the invention are described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in the range from 60° C. to 100° C. at the film surface, and time period for heating is preferably in the range from 1 second to 60 seconds. More preferably, the temperature of the heat treatment is in the range 70° C. to 90° C. at the film surface and time period for heating is 2 seconds to 10 seconds. A preferred method of heat treatment for the invention is described in JP-A No. 2002-107872.

Furthermore, the production methods described in JP-A Nos. 2002-156728 and 2002-182333 are favorably used in the invention in order to stably produce the photothermographic material of the invention continuously.

The photothermographic material is preferably of monosheet type (i.e., a type which can form image on the photothermographic material without using other sheets such as an image-receiving material).

13) Packaging Material

The photothermographic material of the invention is preferably packaged by a packaging material having a low oxygen permeation rate and/or a low moisture permeation rate, in order to avoid an alteration of the photographic performance during storage before use, and to suppress curl or bending. The oxygen permeation rate at 25° C. is preferably 50 ml/atm·m$^2$ ·day or less, more preferably 10 ml/atm·m$^2$·day or less, and further preferably 1.0 ml/atm·m$^2$·day or less. The moisture permeation rate is preferably 10 g/atm·m$^2$·day or less, more preferably 5 g/atm·m$^2$·day or less, and further preferably 1 g/atm·m$^2$·day or less.

Specific examples of packaging materials having a low oxygen permeation rate and/or a low moisture permeation rate include the packaging materials described in JP-A Nos. 8-254793 and 2000-206653.

14) Other Applicable Techniques

Techniques which can be used for the photothermographic material of the invention also include those in EP803764A1, EP883022A1, WO98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-20699, 2001-275471, 2001-275461, 2000-313204, 2001-292844, 2000-324888, 2001-293864, 2001-348546 and 2000-187298.

In instances of multi-color photothermographic materials, each image forming layer is in general, held distinct from each other by using a functional or nonfunctional barrier layer between each image forming layer as described in U.S. Pat. No. 4,460,681.

Constitution of the multi-color photothermographic material may include a combination of these two layers for each color. Alternatively, all ingredients may be included into a single layer as described in U.S. Pat. No. 4,708,928.

(Image Forming Method)

1) Exposure

As a laser beam according to the invention, He—Ne lasers of red through infrared emission, red laser diodes, or $Ar^+$, He—Ne, He—Cd laser of blue through green emission, blue laser diodes, are used. A preferred laser is a red to infrared laser diode and the peak wavelength of laser beam is 600 nm to 900 nm, preferably 620 nm to 850 nm. Even more preferable is a high power laser and, from the perspective of being able to make the photothermographic material of the invention transparent, a red laser diode (780 nm to 810 nm) is preferably used.

In recent years, development has been made in particular of a light source module with an SHG (a second harmonic generator) and a laser diode integrated into a single piece, and a blue diode laser whereby a laser output apparatus in the short wavelength region has come into the limelight. A blue laser diode enables high definition image recording and makes it possible to obtain an increase in recording density and a stable output over a long lifetime, which results in the expectation of expanded demand in the future. The peak wavelength of a blue laser beam is 300 nm to 500 nm, preferably 400 nm to 500 nm.

A laser beam which oscillates in multiple longitudinal modes by a method such as high frequency superposition is also preferably employed.

2) Thermal Development

Although any method may be used for this thermal development process, development of the photothermographic material of the invention is usually performed by elevating the temperature of the photothermographic material which has been exposed imagewise. The temperature for development is preferably 80° C. to 250° C., more preferably 100° C. to 140° C., and further preferably 110° C. to 130° C. Time period for development is preferably 1 second to 60 seconds, more preferably 3 seconds to 30 seconds, further preferably 5 seconds to 25 seconds, and most preferably 7 seconds to 15 seconds.

The conveying speed of a photothermographic material in a thermal developing section is preferably 23 mm/second to 200 mm/second, and more preferably 25 mm/seconds to 100 mm/seconds.

As for the process for thermal development, either drum type heaters or plate type heaters may be used. However, drum type heater processes are more preferred. In order to reduce the size of the thermal developing apparatus and to shorten the time period for thermal development, it is preferably to stably control the heater. Further, it is preferable that the top part of one sheet of the photothermographic material is exposed and thermal development of the exposed portion is started before exposure of the end part of the sheet has been completed.

A preferred imager capable of rapid processing for use in the invention is described in, for example, JP-A Nos. 2002-289804 and 2002-287668. When this imager is used, for example, the thermal development can be carried out for 14 seconds by using plate type heaters which are controlled at three step temperatures of 107° C., 121° C. and 121° C., so that the output time of a first sheet can be reduced to 60 seconds. A thermal developing apparatus having a drum type heater which can be preferably used in the present invention is shown in FIG. 1.

The surface at the side of the protective layer for the image forming layer is preferably heated by contacting with a heating means to carry out uniform heating, and from the perspectives of heating efficiency and workability, and the surface is preferably heated whilst in contact with the heater while the photothermographic material is being conveyed.

In FIG. 1, Numeral 10 denotes an image recording apparatus, Numeral 16 denotes a protecting board, Numerals 36, 38 and 40 denote trays, Numerals 37, 39 and 41 denote windows for reading barcodes, Numerals 43, 45 and 47 denote barcode readers, Numerals 48, 50 and 52 denote sheet feeding mechanisms, Numeral 54 denotes an image recording section, Numeral 56 denotes rollers, Numeral 58 denotes a plate, Numeral 60 denotes a thermal developing section, Numeral 62 denotes rollers, Numerals 64*a*, 64*b* and 64*c* denote plate heaters, Numeral 66 denotes a drum, Numeral 68 denotes a cooling section, Numerals 70 denotes a discharging section, F denotes films, and L denotes a laser beam.

Photothermographic material F is scanned and exposed with laser beam L based on image data from an image recording section 54 in the direction approximately perpendicular to the conveying direction while the photothermographic material is conveyed with driving roller 56. The photothermographic material is continuously conveyed after the imagewise exposure, and is guided to a thermal developing portion 60. The thermal developing portion 60 includes three heating plates 64*a*, 64*b* and 64*c*, and a group of pressing rollers 62 for allowing the photothermographic material to make close contact with the heating plate. The photothermographic material after passing through the thermal developing portion is discharged out of the apparatus after being cooled to a stable temperature range by passing through a cooling portion 68.

3) System

Examples which can be given of a medical laser imager equipped with a light exposing portion and a thermal developing portion include Fuji Medical Dry Laser Imager FM-DPL and DRYPIX 7000, Eastman Kodak Company Dry-View-8700 laser imager plus. In connection with FM-DP L, description is found in Fuji Medical Review No. 8, pages 39 to 55. It goes without saying that those techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system compatible with to DICOM standard.

(Application of the Invention)

The photothermographic material of the invention are preferably employed for forming black and white images by silver imaging as photothermographic materials for use in medical diagnostics, photothermographic materials for use in industrial photographs, photothermographic materials printing, as well as photothermographic materials for COM. Particularly the use as photothermographic materials for medical diagnostics is preferable.

EXAMPLES

The present invention is specifically explained by way of the Examples below, which should not be construed as limiting the invention thereto.

Example 1

(Preparation of PET Support)

1) Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, melted at 300° C. Thereafter, the mixture was extruded from a T-die and rapidly cooled to form a non-oriented film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up with a tension of 4 kg/cm$^2$ to obtain a roll having the thickness of 175 μm.

2) Surface Corona Discharge Treatment

Both surfaces of the support were treated at room temperature at 20 m/minute using Solid State Corona Discharge Treatment Machine Model 6KVA manufactured by Piller GmbH. It was proven that treatment at 0.375 kV·A·minute/m$^2$ was carried out, judging from the readings of current and voltage on that occasion. The frequency upon this treatment was 9.6 kHz, and the gap clearance between the electrode and dielectric roll was 1.6 mm.

3) Undercoating

<Preparations of Coating Solution for Undercoat Layer>

| Formula (1) (for undercoat layer on the image forming layer side) | |
|---|---|
| PESRESIN A-520 manufactured by Takamatsu Oil & Fat Co., Ltd. (30% by mass solution) | 46.8 g |
| VYLONAL MD-1200 manufactured by Toyobo Co., Ltd. | 10.4 g |
| Polyethyleneglycol monononylphenylether (average ethylene oxide number = 8.5) 1% by mass | 11.0 g |
| MP-1000 manufactured by Soken Chemical & Engineering Co., Ltd. (polymer fine particle, mean particle diameter of 0.4 μm) | 0.91 g |
| Distilled water | 931 ml |
| **Formula (2) (for first layer on the back surface)** | |
| Styrene-butadiene copolymer latex (solid content of 40% by mass, styrene/butadiene weight ratio = 68/32) | 130.8 g |
| 8% by mass aqueous solution of 2,4-dichloro-6-hydroxy-S-triazine sodium salt | 5.2 g |
| 1% by mass aqueous solution of sodium laurylbenzenesulfonate | 10 ml |
| Polystyrene particle dispersion (average particle diameter; 2 μm: 20% by mass) | 0.5 g |
| Distilled water | 854 ml |
| **Formula (3) (for second layer on the back surface)** | |
| $SnO_2$/SbO (9/1 weight ratio, mean particle diameter of 0.038 μm, 17% by mass dispersion) | 84 g |
| Gelatin | 7.9 g |
| METOLOSE TC-5 manufactured by Shin-Etsu Chemical Co., Ltd. (2% by mass aqueous solution) | 10 g |
| 1% by mass aqueous solution of sodium dodecylbenzenesulfonate | 10 ml |
| NaOH (1% by mass) | 7 g |
| Proxel (manufactured by Avecia) | 0.5 g |
| Distilled water | 881 mL |

Both surfaces of the biaxially oriented polyethylene terephthalate support having the thickness of 175 μm were subjected to the corona discharge treatment as described above. Thereafter, the aforementioned coating solution of the formula (1) for the undercoat was coated on one surface (image forming layer side) with a wire bar so that the amount of wet coating became 6.6 ml/$m^2$ (per side), and dried at 180° C. for 5 minutes. Then, the aforementioned formula (2) of the coating solution for the undercoat was coated on the reverse face (back surface) with a wire bar so that the amount of wet coating became 5.7 ml/$m^2$, and dried at 180° C. for 5 minutes.

Furthermore, the aforementioned formula (3) of the coating solution for the undercoat was coated on the reverse face (back surface) with a wire bar so that the amount of wet coating became 8.4 ml/$m^2$, and dried at 180° C. for 6 minutes. Thus, an undercoated support was produced.

(Back Layer)

1) Preparation of the Back Layer Coating Liquid

<<Preparation of the Dye A Dispersion Liquid>>

Preparation was made by 15 g of Dye A and 6.4 g of DEMOL N, manufactured by Kao Corporation, being added to 250 g of water and mixed well to form a slurry. Then 800 g of zirconia beads of average diameter 0.5 mm was placed in the vessel with the provided slurry, and dispersed for 25 hours in a dispersion device (¼ G sand grinder mill, manufactured by Aimex Co. Ltd), and by adding water until the dye concentration becomes 5% a dye dispersion was obtained.

Preparation of Anti-halation Layer Coating Liquid

To make the anti-halation layer coating liquid to 37 g of a gelatin with isoelectric point of 4.8 (trade mark: PZ gelatin; manufactured by Miyagi Chemical Industry) and 0.1 g of beizoisothiazolinone was added to water in a vessel maintained at 40° C. and the gelatin was dissolved. Additionaly 43 ml of a 3% by mass aqueous solution of sodium polystyrenesulfonate, 82 g of a 10% by mass solution of SBR latex (styrene/butadiene/acrylate copolymer; mass ratio 68.3/28.7/3.0), and 40 g of dye A dispersion liquid was added.

2) Back Surface Protection Layer Coating Liquid Preparation

To make a back surface protection layer coating liquid to 43 g of a gelatin with isoelectric point of 4.8 (trade mark: PZ gelatin; manufactured by Miyagi Chemical Industry) and 0.21 g of benzoisothiazolinone was added water in a vessel maintained at 40° C. and the gelatin was dissolved. Further, 8.1 ml of 1 mole/l sodium acetate aqueous solution, 0.93g of a homo dispersion of poly (ethyleneglycol dimethacrylate-co-methylmethacrylate) fine particles (average particle size 7.7 μm, standard deviation of particle diameter 0.3 μm), 5 g of a 10% by mass emulsion of liquid paraffin, 10 g of a 10% by mass emulsion of hexaisostearate dipenta pentaerythrite, 10 ml of a 5% aqueous solution by mass of the sodium salt of di(2-ethylhexyl)sulfosuccinate, 17 ml of a 3% solution by mass of polystyrenesulfonate, 2.4 ml of a 2% solution by mass of fluoro surfactant (F-1), 2.4 ml of a 2% solution by mass of fluoro surfactant (F-2), and 30 ml of a 20% solution by mass of ethylacrylate/acrylic acid copolymer (copolymer mass ratio 96.4/3.6) latex were mixed in. Just before coating 50 ml of a 4% solution by mass of N,N-ethylene bis (vinylsulfonacetoamide) was mixed in, and 855 ml of the completed back surface protecting layer coating liquid was thereby made.

(Dye A)

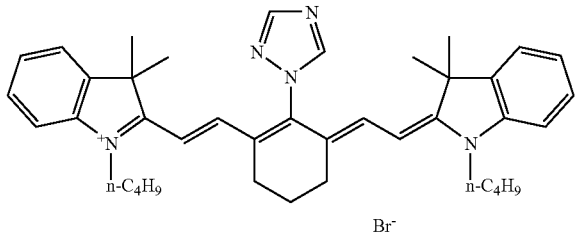

(F-1)

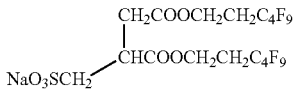

(F-2)

Mixture of:

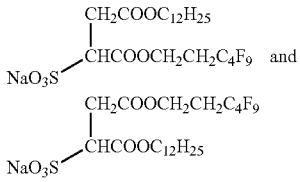

3) Coating of Back Layer

The back surface side of the undercoated support as described above was subjected to simultaneous double coating so that the coating solution for the antihalation layer gives a coating amount of gelatin of 1.0 g/m$^2$, and so that the coating solution for the back surface protective layer gives a coating amount of gelatin of 1.0 g/m$^2$, followed by drying to produce a back layer.

(Image Forming Layer, and Surface Protective Layer)

1. Preparations of Materials for Coating

1) Silver Halide Emulsion

<<Preparation of Silver Halide Emulsion-1>>

To 1421 ml of distilled water was added 3.1 ml of a 1% by mass potassium bromide solution. Further, a liquid added with 3.5 ml of sulfuric acid having the concentration of 0.5 mole/l and 31.7 g of phthalated gelatin was kept at 30° C. while stirring in a stainless steel reaction pot, and thereto were added the total amount of solution A, prepared through diluting 22.22 g of silver nitrate by adding distilled water to give the volume of 95.4 ml, and solution B, prepared through diluting 15.3 g of potassium bromide and 0.8 g of potassium iodide with distilled water to give the volume of 97.4 ml, over a period of 45 seconds at a constant flow rate. Thereafter, 10 ml of a 3.5% by mass aqueous solution of hydrogen peroxide was added thereto, and 10.8 mL of a 10% by mass aqueous solution of benzimidazole was further added.

Moreover, a solution C, prepared through diluting 51.86 g of silver nitrate by adding distilled water to give the volume of 317.5 mL, and a solution D, prepared through diluting 44.2 g of potassium bromide and 2.2 g of potassium iodide with distilled water to give the volume of 400 mL, were added using a controlled double jet method in which a total amount of the solution C was added at a constant flow rate over 20 minutes, accompanied by adding the solution D and while maintaining the pAg at 8.1. Hexachloroiridium (III) potassium salt was added in its entirety to give $1\times10^{-4}$ mole per one mole of silver at 10 minutes post initiation of the addition of the solution C and the solution D. Moreover, at 5 seconds after completing the addition of the solution C, a potassium iron (II) hexacyanide aqueous solution was added at a total amount of $3\times10^{-4}$ mole per one mole of silver. The mixture was adjusted to a pH of 3.8 with sulfuric acid at the concentration of 0.5 mole/L. After stopping stirring, the mixture was subjected to precipitation/desalting/water washing steps. The mixture was adjusted to a pH of 5.9 with sodium hydroxide at the concentration of 1 mole/L to produce a silver halide dispersion having the pAg of 8.0.

The silver halide dispersion was kept at 38° C. with stirring, and thereto was added 5 mL of a 0.34% by mass methanol solution of 1,2-benzoisothiazoline-3-one, followed by elevating the temperature to 47° C. at 40 minutes thereafter. At 20 minutes after elevating the temperature, sodium benzene thiosulfonate in a methanol solution was added in an amount of $7.6\times10^{-5}$ mole per one mole of silver. At additional 5 minutes later, a tellurium sensitizer C in a methanol solution was added in an amount of $2.9\times10^{-4}$ mole per one mole of silver and subjected to ripening for 91 minutes. Thereafter, 1.3 mL of a 0.8% by mass N,N'-dihydroxy-N",N"-diethylmelamine in methanol was added thereto, and at additional 4 minutes thereafter, 5-methyl-2-mercaptobenzimidazole in a methanol solution in an amount of $4.8\times10^{-3}$ mole per one mole of silver, and 1-phenyl-2-heptyl-5-mercapto-1,3,4-triazole in a methanol solution at $5.4\times10^{-3}$ mole per one mole of silver, and sodium 1-(3-methylureido)-5-mercaptotetrazole in an amount of $8.5\times10^{-3}$ mole per one mole of silver were added to produce a silver halide emulsion-1.

Grains in the thus prepared silver halide emulsion were silver iodobromide grains containing 3.5 mole % of iodide uniformly and having a mean sphere equivalent diameter of 0.042 μm, and a spherical diameter variation coefficient of 20%. Grain size and the like were determined from the average of 1000 grains using an electron microscope. The ratio of the [100] plane of the grains measured by Kubelka-Munk method was 80%.

<<Preparation of Silver Halide Emulsion-2>>

Preparation of silver halide emulsion-2 was conducted in a similar manner to the process in the preparation of the silver halide emulsion-1 except that: the temperature at the time when grains were formed was changed from 30° C. to 47° C., the solution B was formed by diluting 15.9 g of potassium bromide to 97.4 mL with distilled water, the solution D was formed by diluting 45.8 g of potassium bromide to 400 mL with distilled water, the addition time of the solution C was changed to 30 minutes, and potassium iron (II) hexacyanide aqueous solution was not added.

In the same way as with the silver halide emulsion-1, grain forming/precipitation/rinsing/dispersion were carried out. Further, the addition amount of the tellurium sensitizing agent C was changed to $5.1\times10^{-5}$ moles per mole of silver, and $3.3\times10^{-3}$ mole per 1 mole of silver of a methanol solution of 1-phenyl-2-heptyl-5-mercapto-1,3,4-triazole and $4.7\times10^{-3}$ mole per 1 mole of silver of an aqueous solution of sodium 1-(3-methylureide)-5-mercaptotetrazole were used. Apart from the above changes the emulsion-2 was obtained in the same way as emulsion-1. The emulsion grains of the silver halide emulsion 2 thus prepared were pure silver bromide particles having an average spherical diameter equivalent of 80 nm, and a variation coefficient of the spherical diameter equivalent of 20%.

(Preparation of the Silver Halide Emulsion 3)

A silver halide emulsion 3 was prepared in the same manner as the emulsion 1, except that the solution temperature at grain formation was changed from 30° C. to 27 ° C. The precipitation/desalting/rinsing steps were executed in the same manner as in the preparation of the silver halide emulsion 1. A silver halide emulsion 3 was obtained in the same manner as that in the case of the silver halide emulsion 1, except that the tellurium sensitizer C was changed to $5.2\times10^{-4}$ mole per 1 mole of silver, and that bromoauric acid in an amount of $5\times10^{-4}$ mole per 1 mole of silver and potassium thiocyanate in an amount of $2\times10^{-3}$ mole per 1 mole of silver were added at 3 minutes after the addition of the tellurium sensitizer. The silver halide emulsion 3 included silver iodobromide grains having an average equivalent spherical diameter of 0.034 μm and a variation factor of the equivalent spherical diameter of 20%, and contained iodine at a uniform 3.5 mole %.

(Preparation of Mixed Emulsion A for Coating Solution)

The silver halide emulsion 1 at 70% by mass, the silver halide emulsion 2 at 15% by mass and the silver halide emulsion 3 at 15% by mass were dissolved, and benzothiazolium iodide in a form of a 1% by mass aqueous solution was added in an amount of $7\times10^{-3}$ mole per 1 mole of silver. Then water was added so as to obtain a silver halide content corresponding to 38.2 g of silver per 1 kg of the mixed emulsion for the coating solution, and sodium 1-(3-methylureide)-5-mercaptotetrazole was added in an amount of 0.34 g per 1 kg of the mixed emulsion for the coating solution.

Spectral Sensitizer A

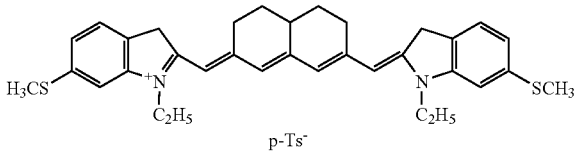

2) Preparation of Dispersion of Silver Salt of Fatty Acid

<Preparation of Recrystallized Behenic Acid>

Behenic acid manufactured by Henkel Co. (trade name: Edenor C22-85R) in an amount of 100 kg was combined with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. Thus resulting crystal was subjected to centrifugal filtration, and washing was performed with 100 kg of isopropyl alcohol. Thereafter, the crystal was dried. Thus resulting crystal was esterified, and subjected to GC-FID analysis to give the results of the content of behenic acid being 96 mole %. In addition, lignoceric acid was included at 2 mole %, arachidic acid was included at 2 mole %, and erucic acid was included at 0.001 mole %.

<Preparation of Nano Particles of Silver Behenate>

In a reaction vessel, deionized water, 10% solution of dodecyl thiopolyacrylamide (72 g) and 46.6 g of recrystallized behenic acid were placed. The content in the reaction vessel was heated at 70° C. with stirring at 150 rpm, while 10% potassium hydroxide solution (70.6 g) was added to the vessel. Thereafter, the content in the reaction vessel was heated at 80° C., and maintained at the same temperature for 30 minutes until the content became a turbid solution. Next, the reaction mixture was cooled to 70° C., and a silver nitrate solution (100% solution, 21.3 g) was added to the reaction vessel over 30 minutes by controlling the speed of adding. The content in the reaction vessel was maintained at the reaction temperature for 30 minutes, cooled to room temperature, and decanted, so that a nanoparticle silver behenate dispersion was obtained (solid content 3%) with median grain size of 150 nm.

<Purification and Concentration of the Silver Behenate Nano Particles>

The nano particle silver behenate dispersion with solid content 3% (12 kg) was placed in a diafiltration/ultrafiltration apparatus (with an Osmonics model 21-HZ20-S8J osmotic membrane cartridge having an effective surface area of 0.34 $m^2$ and a nominal molecular weight cutoff of 50,000). The apparatus was operated so that the pressure going into the osmotic membrane was 50 $lb/in^2$ (3.5 $kg/cm^2$) and the pressure downstream from the osmotic membrane was 20 $lb/in^2$ (1.4 $kg/cm^2$). The permeate was replaced with deionized water until 24 kg of permeate were removed from the dispersion. At this point the replacement water was turned off and the apparatus was run until the dispersion reached a concentration of 28% solids to provide a silver behenate nanoparticule dispersion.

3) Preparations of Reducing Agent Dispersion

To 10 kg of a reducing agent-1 (6,6'-di-t-butyl-4,4'-dimethyl-2,2'-butylydene diphenol) and 16 kg of a 10% by mass aqueous solution of modified polyvinyl alcohol (manufactured by Kuraray Co., Ltd., POVAL MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of benzoisothiazolinone sodium salt and water were added thereto, thereby adjusting the concentration of the reducing agent to be 25% by mass. This dispersion was subjected to heat treatment at 60° C. for 5 hours to obtain a reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

4) Preparation of Developing Accelerator-1 Dispersion

<<Development Accelerator-1 Dispersion>>

To development accelerator (A-1) in an amount of 10 kg, 20 kg of a 10% by mass aqueous solution of modified polyvinyl alcohol (manufactured by Kuraray Co., Ltd., Poval MP203), was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3.5 hours. Thereafter, 0.2 g of a benzoisothiazolinone sodium salt and water were added thereto, thereby adjusting the concentration of the organic polyhalogen compound to be 20% by mass. Accordingly, the development accelerator-1 dispersion was obtained. Particles of the development accelerator included in the resulting development accelerator dispersion had a median diameter of 0.48 μm, and a maximum particle diameter of 1.4 μm or less. The resultant organic polyhalogen compound dispersion was subjected to filtration with a polypropylene filter having a pore size of 3.0 μm to remove foreign substances such as dust, and stored.

<<Development Accelerator-2 Dispersion>>

A solid dispersion of the development accelerator (A-7) was formed by a similar method, to obtain a dispersion liquid of 20% by mass.

5) Preparations of Organic Polyhalogen Compound Dispersion

<<Preparation of Organic Polyhalogen Compound-1 Dispersion>>

An organic polyhalogen compound-1 (tribromomethane sulfonylbenzene) in an amount of 10 kg, 10 kg of a 20% by mass aqueous solution of modified polyvinyl alcohol (manufactured by Kuraray Co., Ltd., Poval MP203), 0.4 kg of a 20% by mass aqueous solution of sodium triisopropylnaphthalenesulfonate and 14 kg of water were added, and thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzoisothiazolinone sodium salt and water were added thereto, thereby adjusting the concentration of the organic polyhalogen compound to be 26% by mass. Accordingly, an organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

An organic polyhalogen compound-2 (N-butyl-3-tribromomethane sulfonylbenzoamide) in an amount of 10 kg, 20 kg of a 10% by mass aqueous solution of modified polyvinyl alcohol (manufactured by Kuraray Co., Ltd., Poval MP203), and 0.4 kg of a 20% by mass aqueous solution of sodium triisopropylnaphthalenesulfonate were added together and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzoisothiazolinone sodium salt and water were added thereto, thereby adjusting the concentration of the organic polyhalogen compound to be 30% by mass. This fluid dispersion was heated at 40° C. for 5 hours to obtain an organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm, to remove foreign substances such as dust, and stored.

6) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry Zirconia beads having the mean particle diameter of 0.5 mm were provided in an amount of 800 g, and packed in a vessel with the slurry. Dispersion was performed with a dispersing machine (1/4G sand grinder mill: manufactured by AIMEX Co., Ltd.) for 25 hours. Thereto was added water to adjust so that the concentration of the pigment became 5% by mass to obtain a pigment-1 dispersion. Particles of the pigment included in the resulting pigment dispersion had a mean particle diameter of 0.21 μm.

7) Preparation of Aqueous Solutions

The following compounds were added to prepare aqueous solutions thereof:

succinimide 5% by mass aqueous solution was prepared;

4-methylphthalate 5% by mass aqueous solution was prepared;

thickening agent, sodium polystyrenesulfonate (MW=10000) 4% by mass aqueous solution was prepared.

2. Coating Liquid Preparation

1) Preparation of the Image Forming Layer Coating Liquid Into a vessel maintained at 40° C. was placed 450 ml of water, the gelatin (the amount of gelatin added is indicated in Table 1), and after the gelatin had dissolved, the above obtained silver fatty acid dispersion, pigment-1 dispersion, organic polyhalogen compound-1 dispersion, organic polyhalogen compound-2 dispersion, the compound according to formula (I) or (II) (as shown in Table 1), the reducing agent dispersion, the development accelerator-1 dispersion, the development accelerator-2 dispersion, 4-methylphthalate aqueous solution, sodium iodide, and thickening agent were added in sequence. Immediately before coating, the silver halide mixture emulsion A was added and well stirred and then in that state the liquid was fed as the image forming layer coating liquid to the coating die. The amount of the thickening agent was adjusted such that the viscosity at 40° C. was 50 mPa·s. The amount of zirconium in the coating liquid was 0.18 mg per gram of silver.

2) Preparation of the Surface Protection Layer Coating Liquid

Into a vessel maintained at 40° C. was placed 2400 ml of water, 300 g of gelatin, and, preparation was made by, after dissolving the gelatin, 60 g of a 5% by mass solution of di(2-ethylhexyl)sulfosuccinic acid sodium salt, 900 g of succinimide aqueous solution, and 10 ml of thickening agent solution being added in sequence, stirred thoroughly. The viscosity of the coating liquid was 35 mPa·s at 40° C.

3. Preparation of Photothermographic Materials 1 to 11

Samples of the photothermographic materials were made by simultaneous multiple coating using slide bead coating, on the opposite surface from the back surface, in sequence from the undercoat surface up to the image forming layer or surface protection layer. Here, the coating liquid temperature for the image forming layer and the surface protection layer was adjusted to be 40° C. The coating was carried out at a speed of 350 m/min.

The coating amounts (g/m$^2$) of each of the compounds in the image forming layer were as set out below. And, the coating of the surface protection layer was carried out such that the dry coating amount was 2.0 (g/m$^2$).

| | |
|---|---|
| Silver fatty acid | 5.42 |
| Pigment (C.I. Pigment Blue 60) | 0.036 |
| Polyhalogen compound-1 | 0.10 |
| Polyhalogen compound-2 | 0.34 |
| 4-methylphthalate | 0.08 |
| Succinimide | 0.54 |
| Compound of formula (1) or (II) (as per Table 1) | |
| Gelatin (as shown in Table 1) | |
| Sodium Iodide | 0.04 |
| Reducing agent-1 | 0.75 |
| Development accelerator-1 | 0.015 |
| Development accelerator-2 | 0.011 |
| Silver halide (as silver) | 0.10 |

TABLE 1

| Sample No. | Organic Silver/ Gelatin Ratio (ratio by mass) | Compound of Formulas (I) and (II) Type | Coating amount (g/m$^2$) | Coatability | Photogaphic performance Fogging | Dmax | Dirt on developing apparatus | Image Preservation | Comment |
|---|---|---|---|---|---|---|---|---|---|
| 1 | 0.5 | Succinimide | 0.35 | B | 100 | 100 | A | 100 | Comparative example |

TABLE 1-continued

| Sample No. | Organic Silver/ Gelatin Ratio (ratio by mass) | Compound of Formulas (I) and (II) Type | Coating amount ($g/m^2$) | Coatability | Photogaphic performance Fogging | Dmax | Dirt on developing apparatus | Image Preservation | Comment |
|---|---|---|---|---|---|---|---|---|---|
| 2 | 0.7 | Succinimide | 0.35 | A | 101 | 127 | A | 102 | Invention |
| 3 | 0.9 | Succinimide | 0.35 | A | 100 | 125 | A | 101 | Invention |
| 4 | 1.1 | Succinimide | 0.35 | A | 99 | 120 | A | 100 | Invention |
| 5 | 1.3 | Succinimide | 0.35 | B | 105 | 122 | B | 102 | Invention |
| 6 | 1.7 | Succinimide | 0.35 | C | 138 | 125 | C | 183 | Comparative example |
| 7 | 0.5 | None | N/A | A | 95 | 76 | A | 98 | Comparative example |
| 8 | 0.9 | None | N/A | A | 97 | 81 | A | 99 | Invention |
| 9 | 0.9 | Phthalimide | 0.35 | A | 101 | 122 | A | 100 | Invention |
| 10 | 0.9 | II-1 | 0.35 | A | 100 | 123 | A | 99 | Invention |
| 11 | 0.9 | II-5 | 0.35 | A | 98 | 125 | A | 100 | Invention |

Below are the chemical structures of the compounds used in the Examples of the invention.

(Reducing Agent-1)

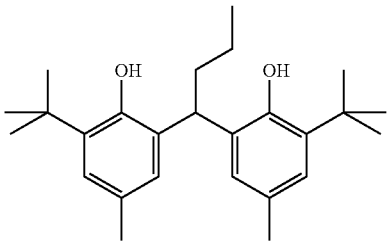

(Polyhalogen Compound-1)

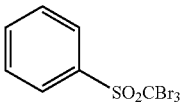

(Polyhalogen Compound-2)

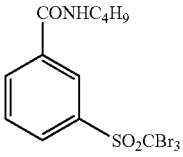

(Development Accelerator-1)

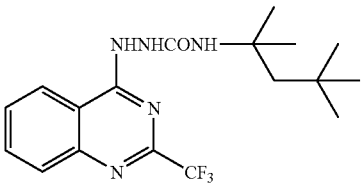

-continued (Development Accelerator-2)

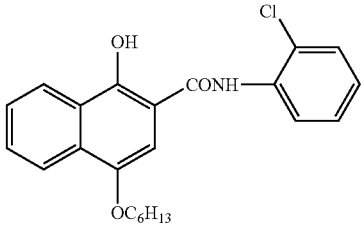

4. Evaluation of Function 4-1 Coating Surface Evaluation

The whole of the surface was uniformly exposed for each of the samples so that the density was 1.5, and thermo-development was carried out according to the photographicability evaluation conditions listed below, the number of streaks in the coating per unit width was evaluated. Coating streaks are defects in the coating, and the fewer the number the better, showing superior coating ability.

The coating criteria were the following.

A No streaks

B A small amount of low density streaks occurred

C A small amount of high density streaks occurred

D Coating streaking occurred across the whole surface 4-2 Photographic Performance 1) Criteria The samples obtained were trimmed down into half-trim size (43 cm length×35 cm width), wrapped in the below packaging material in an environment of 25° C. and 50% RH, and then evaluation was carried out after keeping for 2 weeks at room temperature.

<Packaging Material>

A laminate film of PET 10 μm/PE 12 μm/Aluminum foil 9 μm/Ny 15 μm/Polyethylene containing 3% carbon by mass 50 μm.

Oxygen permeability: 0.02 $mL \cdot atm^{-1} \cdot m^{-2} \cdot day^{-1}$ at 25° C.
Water permeability: 0.10 $g \cdot atm^{-1} \cdot m^{-2} \cdot day^{-1}$ at 25° C.

2) Photothermographic Material Exposure and Development

Using a drum heating unit as shown in FIG. 1 exposure was carried out of each of the samples, using a 810 nm laser, and thermal development. For each of the samples the conveying speed was adjusted such that in the heat development unit the linear speed is 25 mm/second. The temperature of the heating unit was 124° C., and the heating was carried out for 13 seconds.

3) Evaluation Aspects

Fogging: The density of the unexposed portions

Dmax: The maximum density which can be achieved by increasing the exposure

These are shown for each of the samples using a relative index, with sample 1 as 100.

4-3 Evaluation of Image Preservation

The samples obtained after finishing processing were kept for a week under conditions of 60° C. and 50% RH, and the increase in density in the fogging areas was evaluated. This is shown using a relative index with sample 1 as 100.

4-4. Dirt on the Development Apparatus

After exposure of the samples using the above conditions, 10 000 half-trim size sheets were continuously processed on the thermal development drum which had been previously cleaned.

After this processing the dirt on the thermal development drum was evaluated by visual inspection according to the criteria below.

A: No dirt visible at all

B: A small amount of dirt is visible on both edges of the drum

C: Dirt is visible over all of the drum 4-5 Evaluation Result

The results are shown in Table 1.

The photothermographic material using an organic silver/gelatin ratio of the invention and the compounds of the invention according to formulas (I) and (II) is good in coating condition, has a high developing activity, causes little dirtying of the development apparatus, and has good image retainability after processing.

Example 2

Samples 12 to 17 were made by using the reducing agents as shown in Table 2, instead of the reducing agent-1, at the same quantities, substituted in the sample 3 of Example 1.

The evaluation of Example 2 was carried out in the same way as the evaluation of Example 1. Good functionality was shown in all samples.

TABLE 2

| Sample | No. of Reducing | Coating | Photographic Performance | | Dirt on development | Image preservation | |
|---|---|---|---|---|---|---|---|
| No. | agent | condition | Fogging | Dmax | apparatus | Fogging | Comment |
| 3 | 1 | A | 100 | 125 | A | 101 | Invention |
| 12 | R1-1 | A | 100 | 135 | A | 103 | Invention |
| 13 | R1-2 | A | 100 | 135 | A | 102 | Invention |
| 14 | R1-5 | A | 101 | 130 | A | 100 | Invention |
| 15 | R1-6 | A | 101 | 123 | A | 101 | Invention |
| 16 | R1-8 | A | 99 | 125 | A | 99 | Invention |
| 17 | R1-9 | A | 100 | 132 | A | 102 | Invention |

Example 3

Samples 20 to 25 were made by using the development accelerators as shown in Table 3 substituted in the sample 3 of Example 1.

The evaluation of Example 3 was carried out in the same way as the evaluation of Example 1. Good functionality was shown in all samples but particularly good functionality was obtained when a development accelerator was used in an effective amount.

TABLE 3

| Sample | Developing accelerator-1 | | Developing Accelerator-2 | | Coating | Photographic performance | | Dirt on developing | Image | |
|---|---|---|---|---|---|---|---|---|---|---|
| No. | Type | Adding amount ($g/m^2$) | Type | Adding amount ($g/m^2$) | Condition | Fogging | Dmax | apparatus | preservation | Comment |
| 3 | (A-1) | 0.015 | (A-7) | 0.011 | A | 100 | 125 | A | 101 | Invention |
| 20 | None | N/A | None | N/A | A | 95 | 118 | A | 98 | Invention |
| 21 | (A-1) | 0.022 | None | N/A | A | 102 | 126 | A | 100 | Invention |
| 22 | None | N/A | (A-7) | 0.0119 | A | 98 | 125 | A | 100 | Invention |
| 23 | (A-2) | 0.015 | (A-7) | 0.011 | A | 101 | 128 | A | 102 | Invention |

TABLE 3-continued

| Sample | Developing accelerator-1 | | Developing Accelerator-2 | | Coating | Photographic performance | | Dirt on developing | Image | |
|---|---|---|---|---|---|---|---|---|---|---|
| No. | Type | Adding amount ($g/m^2$) | Type | Adding amount ($g/m^2$) | Condition | Fogging | Dmax | apparatus | preservation | Comment |
| 24 | (A-6) | 0.018 | (A-10) | 0.012 | A | 102 | 122 | A | 99 | Invention |
| 25 | (A-6) | 0.018 | (A-12) | 0.01 | A | 101 | 126 | A | 101 | Invention |

According to the invention a photothermographic material and an image forming method of the same that has good surface coating, together with low fogging can be provided.

What is claimed is:

1. A photothermographic material comprising a support body provided on or above at least one surface thereof with an image forming layer, containing at least a photosensitive silver halide, a non-photosensitive organic silver salt, a reducing agent and binder, and a non-photosensitive layer, wherein:

50% or more of the binder in the image forming layer is hydrophilic binder;

a ratio of the non-photosensitive organic silver salt to the hydrophilic binder is from 0.6 to 1.4 by mass;

70% or more of binder in the non-photosensitive layer is hydrophilic binder;

the photothermographic material includes at least one of the compounds represented by the Formulas I or II below, Formula I

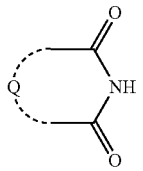

wherein Q represents an atomic group necessary for forming a 5 or 6 member imide ring, Formula II

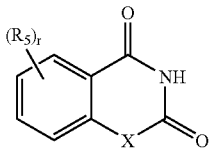

wherein $R_5$ (s) independently represent a hydrogen atom, an alkyl group, a cycloalkyl group, an alkoxy group, an alkylthio group, an arylthio group, a hydroxy group, a halogen atom, or $N(R_8R_9)$ group, where $R_8$ and $R_9$ each independently represent a hydrogen atom, an alkyl group, an aryl group, a cycloalkyl group, an alkenyl group or a hetero ring; r is 0, 1 or 2; $R_8$ and $R_9$ can be linked together to form a substituted or unsubstituted 5 to 7 member hetero ring; 2 of the $R_5$ groups can be linked together to form an aromatic, hetero aromatic, alicyclic ring or condensed hetero cyclic ring; X represents O, S, Se or $N(R_6)$, were $R_6$ is a hydrogen atom, alkyl group, aryl group, cycloalkyl group, alkenyl group or heterocyclic group.

2. The photothermographic material of claim 1 wherein a ratio of an amount of silver relative to the hydrophilic binder in the image forming layer is from 0.6 to 1.2 by mass.

3. The photothermographic material of claim 1 containing at least one of a polyacryl amide or a derivative thereof.

4. The photothermographic material of claim 3 the non-photosensitive organic silver salt is one in which non-photosensitive organic silver salt particles are formed in the presence of the at least one of a polyacrylamide or a derivative thereof.

5. The photothermographic material of claim 3 wherein the non-photosensitive organic silver salt has been rinsed with an aqueous solution containing the at least one of a polyacryl amide or a derivative thereof.

6. The photothermographic material of claim 3 wherein the non-photosensitive organic silver salt is in the form of nano particles.

7. The photothermographic material of claim 6 wherein an average particle size of the nano particles is from 10 nm to 500 nm.

8. The photothermographic material of claim 6 wherein the non-photosensitive layer is the outermost layer on the same side as the image forming layer.

9. The photothermographic material of claim 2 wherein the hydrophilic binder in the image forming layer is gelatin or a gelatin derivative.

10. The photothermographic material of claim 2 wherein the hydrophilic binder in the non-photosensitive layer is gelatin or a gelatin derivative.

11. The photothermographic material of claim 9 further comprising a gelatin or gelatin derivative thickening agent.

12. The photothermographic material of claim 1 wherein the reducing agent is one represented by the following Formula R:

Formula R

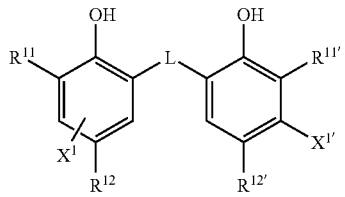

where: $R^{11}$ and $R^{11'}$ each independently represent an alkyl group, and at least one of which is a secondary or tertiary alkyl group; $R^{12}$ and $R^{12'}$ each independently represent a hydrogen atom, or a substitute group which is substitutable for a hydrogen atom on a benzene ring; L represents an —S— group, or a —$CHR^{13}$— group, where $R^{13}$ represents a hydrogen atom or an alkyl group; $X^1$ and $X^{1'}$ each independently represent a hydrogen atom or a substitute group which is substitutable for a hydrogen atom on a benzene ring.

13. The photothermographic material of claim 12 further comprising a development accelerator.

14. A image forming method using the photothermographic material of claim 13 in which, when the photothermographic material is being developed, the linear speed is within the range from 23 mm per second to 200 mm per second.

* * * * *